US011241887B2

(12) United States Patent
Watanabe et al.

(10) Patent No.: US 11,241,887 B2
(45) Date of Patent: Feb. 8, 2022

(54) INK JET PRINTING METHOD AND INK JET PRINTING APPARATUS

(71) Applicant: Seiko Epson Corporation, Tokyo (JP)

(72) Inventors: Tadashi Watanabe, Shiojiri (JP); Ippei Okuda, Shiojiri (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/802,609

(22) Filed: Feb. 27, 2020

(65) Prior Publication Data

US 2020/0276828 A1 Sep. 3, 2020

(30) Foreign Application Priority Data

Feb. 28, 2019 (JP) ..... JP2019-035173

(51) Int. Cl.
*B41J 2/21* (2006.01)
*B41J 2/165* (2006.01)

(52) U.S. Cl.
CPC ..... *B41J 2/2114* (2013.01); *B41J 2/1652* (2013.01)

(58) Field of Classification Search
CPC ..... B41J 2/2114; B41J 2/1652
See application file for complete search history.

(56) References Cited

U.S. PATENT DOCUMENTS

2009/0304927 A1* 12/2009 Kamibayashi ..... C09D 11/40 427/258
2014/0098146 A1* 4/2014 Kamiyama ..... B41J 2/175 347/6
2017/0247561 A1 8/2017 Nakagawa et al.
2019/0284420 A1* 9/2019 Sugiyama ..... C09D 11/033

FOREIGN PATENT DOCUMENTS

JP 2018-094902 A 6/2018

* cited by examiner

*Primary Examiner* — Sharon Polk
(74) *Attorney, Agent, or Firm* — Harness, Dickey & Pierce, P.L.C.

(57) ABSTRACT

An ink jet printing method includes an application step of ejecting a coloring ink composition functioning to color a printing medium through an ejection opening of a first ink jet head to apply the coloring ink composition onto a printing medium, and an application step of ejecting a non-coloring composition different from the coloring ink composition through an ejection opening of a second ink jet head to apply the non-coloring composition onto the printing medium. The coloring ink composition is circulated through a circulation path connected to the first ink jet head after being fed into the first ink jet head and before being ejected through the ejection opening of the first ink jet head. The non-coloring composition is not circulated through a circulation path after being fed into the second ink jet head and before being ejected through the ejection opening of the second ink jet head.

25 Claims, 3 Drawing Sheets

INK JET PRINTING METHOD AND INK JET PRINTING APPARATUS

The present application is based on, and claims priority from, JP Application Serial Number 2019-035173, filed Feb. 28, 2019, the disclosure of which is hereby incorporated by reference herein in its entirety.

BACKGROUND

1. Technical Field

The present disclosure relates to an ink jet printing method and an ink jet printing apparatus.

2. Related Art

Ink jet printing methods, which enable high-definition printing with a relatively simple apparatus, continue to be rapidly developed in various fields, and a variety of researches have been conducted for consistently producing high-quality printed items.

For example, JP-A-2018-94902 discloses an ink set including an ink containing a coloring material and a surface treatment liquid composition that can be stably stored and impart a high lamination strength to an object to be printed. The surface treatment liquid composition contains nonionic resin particles and a multivalent metal salt.

When such an ink set as disclosed in JP-A-2018-94902 is used, the coloring material, particularly pigment, in the ink often clogs the ejection openings of the ink jet head through which the ink is ejected due to thickening caused by drying, resulting in ejection failure and degraded image quality.

From the viewpoint of improving ejection consistency, an ink jet head may be provided with a circulation path to circulate the ink and thus prevent the ink from thickening. However, to circulate inks through the circulation path of the respective ink jet heads, the size and the mass of the ink jet printing apparatus are increased, resulting in increased costs in transport and manufacture.

SUMMARY

Accordingly, there is provided an ink jet printing method and an ink jet printing apparatus that can produce high image quality without increasing the size and the mass of the ink jet printing apparatus.

DESCRIPTION OF EXEMPLARY EMBODIMENTS

Figure 1:
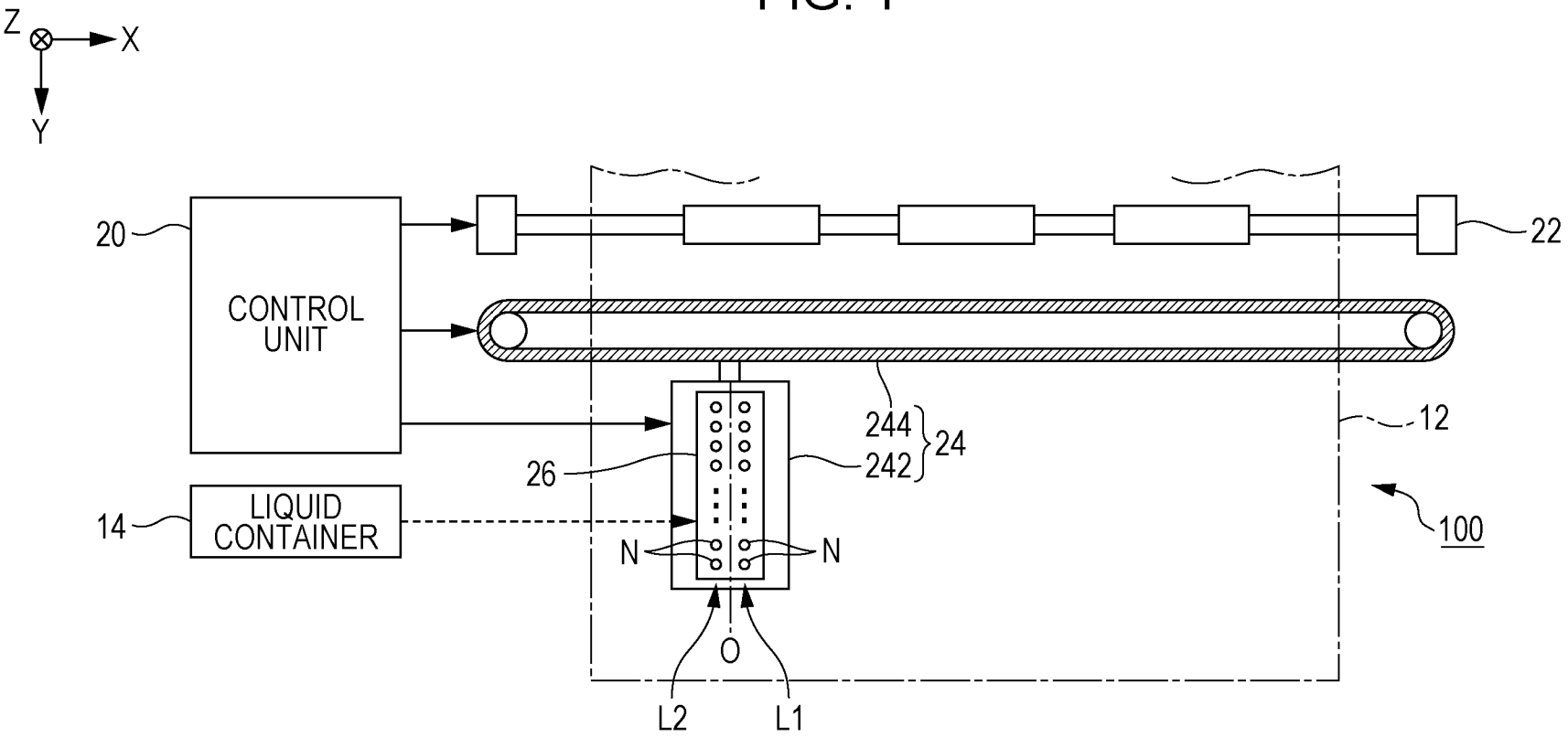
FIG. 1 is a block diagram of an ink jet printing apparatus according to an embodiment of the present disclosure.

Some embodiments of the present disclosure will now be described in detail with reference to the drawings as needed. However, the implementation of the concept of the present disclosure is not limited to the embodiments described herein, and various modifications may be made without departing from the scope and spirit of the present disclosure. The same elements in the drawings are designated by the same reference numerals, and thus description thereof is omitted. The relative positions and other positional relationships comply with the drawings unless otherwise specified. The dimensional proportions in the drawings are not limited to those illustrated in the drawings.

Ink Jet Printing Method

The printing method disclosed herein includes a first application step of ejecting a coloring ink composition through an ejection opening of a first ink jet head to apply the ink composition onto a printing medium, and a second application step of ejecting a non-coloring composition through an ejection opening of a second ink jet head to apply the non-coloring composition onto the printing medium. The coloring ink composition is circulated through a circulation path after being fed to the first ink jet head and before being ejected through the ejection opening of the first ink jet head. In contrast, the non-coloring composition is not circulated through a circulation path after being fed to the second ink jet head and before being ejected through the ejection opening of the second ink jet head.

If the non-coloring composition circulates between the ink jet head and a circulation path in the same manner as the coloring ink composition, the circulation may cause adverse effects. It may be better not to circulate the non-coloring composition. More specifically, circulation of a non-coloring composition containing resin particles or a wax in a large proportion causes foreign matter to increase at ejection openings, consequently reducing the lifetime of the filter and degrading ejection consistency. Circulation of a non-coloring composition containing a surfactant or an antifoaming agent in a large proportion causes the non-coloring composition to form oil droplets, consequently degrading ejection consistency. Circulation of a non-coloring composition that is a treatment liquid containing a flocculant and resin particles or a wax promotes a reaction between the flocculant and the resin particles or the wax to produce foreign matter, consequently degrading ejection consistency. However, the ink jet printing method disclosed herein does not cause any of such adverse effects and is therefore beneficial.

The first application step may be performed after the second application step, or the second application step may be performed after the first application step. Also, the first application step and the second application step may be performed simultaneously. The ink jet printing method may further include a heating step, a post-application heating step, and a flushing step, each individually performed simultaneously with or after or before the first application step and the second application step.

Heating Step

In an embodiment, the ink jet printing method may include a heating step of heating the printing medium. The heating step, which accompanies the application steps, is performed before or during the application steps so that the composition can be applied onto the printing medium heated in the heating step.

The heating step may be performed for either the first application step or the second application step or both.

The heating step promotes the evaporation of the composition applied onto the printing medium for rapid dry. Heating for the first application step reduces bleeding of the ink composition to increase image quality. The heating device used in the heating step is not particularly limited provided that it can heat the printing medium. A heater is an example of such a heating device. The heating device may be a conduction type operable to conduct heat to the printing medium through a member in contact with the printing medium, such as a printing medium support; a blowing type causing a fan or the like to send warm or hot air to the printing medium; or a radiation type operable to irradiate the printing medium with heat-generating radiation, such as IR radiation. Any of these heating devices may be used in the heating step. In some embodiments, the first application step is performed on the printing medium heated to a temperature higher than room temperature by the heating step from the viewpoint of obtaining high image quality.

First Application Step

In the first application step, a coloring ink composition is ejected through ejection openings of the first ink jet head to apply the coloring ink composition onto a printing medium. The first application step may be performed by line printing that uses a printing head having a length larger than or equal to the width of the printing medium and that enables printing across the width of the printing medium with one scanning operation. Alternatively, the first application step may be performed by serial printing, which may be referred to as multi-pass printing). In some embodiments, the first application step is performed by line printing. Such line printing enables high-speed printing compared to multi-pass printing accompanying a plurality of times of scanning operation. Also, the use of an ink jet head having a length larger than or equal to the width of the printing medium may be implemented by using a single long ink jet head or by using an ink jet head unit or the like in which a plurality of ink jet heads are arranged. In some embodiments, the first application step may use one or more ink jet heads individually assigned for each color. The first application step may be performed simultaneously with or before or after the second application step.

For line printing, the first ink jet head and the second ink jet head are disposed downstream and upstream in the direction in which the printing medium is transported (hereinafter referred to as medium transport direction). Printing is performed with scanning operation that is performed by ejecting a coloring ink composition and a non-coloring composition through ejection openings of the first ink jet head and the second ink jet head, respectively, while the printing medium is being transferred in the medium transport direction.

Either the first ink jet head or the second ink jet head may be disposed upstream. The application from the ink jet head disposed upstream is previously performed to the application from the ink jet head disposed downstream.

Serial printing will be described later herein.

In the application steps, the surface temperature of the printing medium when the composition is applied may be 20° C. or more, for example, 25° C. or more, 30° C. or more, or 32° C. or more, and may also be 45° C. or less, for example, 40° C. or less or 38° C. or less. When the surface temperature of the printing medium is controlled in such a range, image quality can be improved, and adverse effects of heat from the ink jet head is minimized, thus enhancing ejection consistency and increasing the lifetime of the filter.

The surface temperature of the printing medium when the composition is applied is controlled in the above range in either the first application step or the second application step or both. If the surface temperature is controlled in both of the application steps, the surface temperature to be controlled may be the same or difference.

Second Application Step

In the second application step, a non-coloring composition is ejected through ejection openings of the second ink jet head to apply the non-coloring composition onto the printing medium. In an embodiment in which the second application step is performed after the first application step, a clear ink or a treatment liquid may be applied as the non-coloring composition onto the printing medium by an ink jet method, thus suppressing surface deterioration of the printing medium and increasing abrasion resistance. In particular, use of a clear ink as the non-coloring composition increases abrasion resistance and is therefore beneficial.

In an embodiment in which the second application step is performed before the first application step, a clear ink or a treatment liquid may be applied as the non-coloring composition onto the printing medium, thus improving image quality. Also, such a non-coloring composition increases the adhesion of the coloring ink composition to the printing medium, thus increasing abrasion resistance. From the viewpoint of improving image quality, a treatment liquid may be used. From the viewpoint of increasing abrasion resistance, a clear ink may be used.

Serial printing enables the first application step and the second application step to be performed simultaneously.

Post-Application Heating Step

The printing method disclosed herein may further include a post-application heating step of heating the printing medium after the first and the second application step. The post-application heating step may be the step of final heating for bringing the printed item into a condition ready to use. The surface temperature of the printing medium in the post-application heating may be from 50° C. to 120° C., for example, from 60° C. to 100° C. or from 70° C. to 90° C. The heating mechanism used in the post-application heating step may be the same as or similar to the heating device described above. The printing apparatus may be provided with an additional heating device or heating mechanism for the post-application heating, or a heating mechanism may be shared between the heating steps.

Flushing Step

The printing method disclosed herein may include a flushing step of discharging the coloring ink composition and the non-coloring composition through the ejection openings of the first ink jet head and the second ink jet head, respectively, for maintenance. The flushing step prevents the compositions from drying into foreign matter at the ejection openings of the first and the second ink jet head, thus ensuring consistent ejection.

The flushing step may be performed at predetermined regular intervals during printing or at the beginning or the completion of printing. In an embodiment, the flushing step may be performed by discharging the compositions onto the printing medium apart from the application for printing. For example, the compositions may be discharged onto an area where images are not printed, thus flushing the ejection openings. In this instance, the ink jet heads do not need moving for flushing during printing.

In an embodiment, the compositions may be discharged onto or into a member of the printing apparatus for flushing. For example, the composition may be discharged into a flushing box provided for flushing. Flushing onto or into a member does not cause the composition to contaminate other members. Flushing may be performed by discharging the compositions onto or into any other member. For example, the compositions may be discharged onto a cap for moisture retention covering the nozzle face of the heads while the printing apparatus does not operate. Alternatively, the compositions may be discharged onto a wiping member that functions to wipe the nozzle face of the ink jet head for cleaning. In this instance, the printing apparatus does not need to be provided with a member to receive the composition discharged for flushing.

Circulation Step

The printing method disclosed herein may include a circulation step of circulating the composition fed into an ink jet head through a circulation path that will be described later herein.

Composition Heating Step

The printing method may also include a heating step of heating a composition with a composition heating mechanism that will be described later herein.

Printing Medium

The printing medium may be absorbent, poorly absorbent, or non-absorbent. In some embodiments, the printing medium is poorly absorbent or non-absorbent. A poorly absorbent or a non-absorbent printing medium mentioned herein is such that the printing surface of the medium can absorb water at a rate of 10 $mL/m^2$ or less for a period of 30 ms from the beginning of contact with water when measured by Bristow's method. The Bristow's method is most broadly used for measuring liquid absorption in a short time, and Japan Technical Association of the Pulp and Paper Industry (JAPAN TAPPI) officially adopts this method. Details of this method are specified in Standard No. 51 (Paper and Paperboard—Liquid Absorption Test Method—Bristow's Method (in Japanese)) of JAPAN TAPPI Paper and Pulp Test Methods edited in 2000 (in Japanese).

Non-absorbent and poorly absorbent media may be classified by the wettability of water on the printing surface thereof. For example, printing media may be characterized by measuring the rate of decrease in contact angle of 0.5 μL of water dropped on the printing surface of each printing medium (comparing the contact angle 0.5 millisecond after landing with the contact angle 5 seconds after landing). More specifically, non-absorbent printing media refer to those exhibiting a contact angle decreasing rate of less than 1%, and poorly absorbent printing media refer to those exhibiting a contact angle decreasing rate in the range of 1% to less than 5%. Absorbent media refer to those exhibiting a contact angle decreasing rate of 5% or more. The contact angle can be measured with, for example, a portable contact angle meter PCA-1 (manufactured by Kyowa Interface Science).

Absorbent printing media include, but are not limited to, plain paper, such as electrophotographic paper having high permeability to ink compositions; ink jet paper having an ink-absorbent layer containing silica particles or alumina particles or an ink-absorbent layer made of a hydrophilic polymer, such as polyvinyl alcohol (PVA) or polyvinyl pyrrolidone (PVP); and art paper, coat paper, and cast-coated paper that are used for ordinary offset printing and have relatively low permeability to ink.

The poorly absorbent printing medium may be, but is not limited to, coated paper including a coating layer at the surface thereof for receiving oil-based ink. The coated paper may be, but is not limited to, book-printing paper, such as art paper, coat paper, or matte paper.

More specifically, the non-absorbent printing medium may be, but is not limited to, a plastic film not provided with an ink-absorbent layer, or a paper sheet or any other base material coated or bonded with a plastic film. The term plastic mentioned here may be polyvinyl chloride, polyethylene terephthalate, polycarbonate, polystyrene, polyurethane, polyethylene, or polypropylene.

The printing medium may be an ink-non-absorbent or poorly ink-absorbent plate made of a metal, such as iron, silver, copper, or aluminum, or glass.

The printed items using a poorly absorbent or non-absorbent medium can be resistant to water and rubbing.

Printing Apparatus

The printing apparatus according to an embodiment that can be used in the printing method disclosed herein will now be described. The printing apparatus is not particularly limited provided that it can perform the printing method according to an embodiment of the present disclosure. More specifically, the printing apparatus includes a first ink jet head to which a coloring ink composition is fed, a circulation path connected to the first ink jet head, a circulation mechanism operable to cause the coloring ink composition fed to the first ink jet head to circulate through the circulation path, and a second ink jet head to which a non-coloring composition is fed. The non-coloring composition fed to the second ink jet head is not circulated through any circulation path. In the following description, when it is not necessary to differentiate between the coloring ink composition and the non-coloring composition, they are simply referred to as the composition(s).

The printing apparatus may be a serial type or a line type. In either case, the printing apparatus includes ink jet heads, and the ink jet heads eject a predetermined volume (or mass) of droplets of a composition through nozzle openings of the heads onto the printing surface of a printing medium at a predetermined timing while changing the relative position with respect to the medium, thus applying the compositions onto the printing medium to print a predetermined text or image. In the following description, the ink jet printing apparatus and the first ink jet head will mainly be described for illustrating the details of the circulation mechanism with reference to FIGS. 1 to 3.

FIG. 1 is a block diagram of an ink jet printing apparatus 100 according to an embodiment of the present disclosure. The illustrated printing apparatus is a serial printing apparatus. The ink jet printing apparatus 100 ejects compositions onto a printing medium 12 by an ink jet method. As illustrated in FIG. 1, the ink jet printing apparatus 100 includes a liquid container 14 adapted to store a composition. For example, the ink container 14 may be a cartridge removable from the ink jet printing apparatus 100, an ink bag made of a flexible film, or an ink tank capable of being refilled with the composition. The liquid container 14 holds a plurality of coloring ink compositions that are different in color and a non-coloring composition.

The ink jet printing apparatus 100 also includes a control unit 20, a transport mechanism 22, a transfer mechanism 24, and an ink jet head 26, as illustrated in FIG. 1. The control unit 20 includes a processing circuit, such as a central processing unit (CPU) or a field-programmable gate array (FPGA), and a memory circuit, such as a semiconductor memory device, and controls overall the components or members of the ink jet printing apparatus 100. The transport mechanism 22 transports the printing medium 12 in the Y direction under the control of the control unit 20.

The transfer mechanism 24 reciprocally moves the ink jet head 26 in the X direction under the control of the control unit 20. The X direction is a direction intersecting (typically perpendicular to) the Y direction in which the printing medium 12 is transported. The transfer mechanism 24 includes a transfer box 242 (carriage) adapted to accommodate the ink jet head 26 and a transfer belt 244 to which the transfer box 242 is secured. In an embodiment, the transfer box 242 may accommodate a plurality of ink jet heads 26, or the liquid container 14, as well as the ink jet heads 26, may be accommodated in the transfer box 242.

The ink jet head 26 ejects a composition fed from the ink container 14 onto the printing medium 12 through a plurality of nozzles N (ejection openings) under the control of the control unit 20. The ink jet head 26 ejects the composition onto the printing medium 12 along with the transport of the medium 12 by the transport mechanism 22 and the reciprocal movement of the transfer box 242, thus forming a desired image on the surface of the printing medium 12. A direction perpendicular to the X-Y plane (parallel to the surface of the printing medium 12) is hereinafter referred to as the Z direction. The direction in which compositions are ejected from the respective ink jet heads 26, typically, in the vertical direction, is the Z direction.

Figure 2:
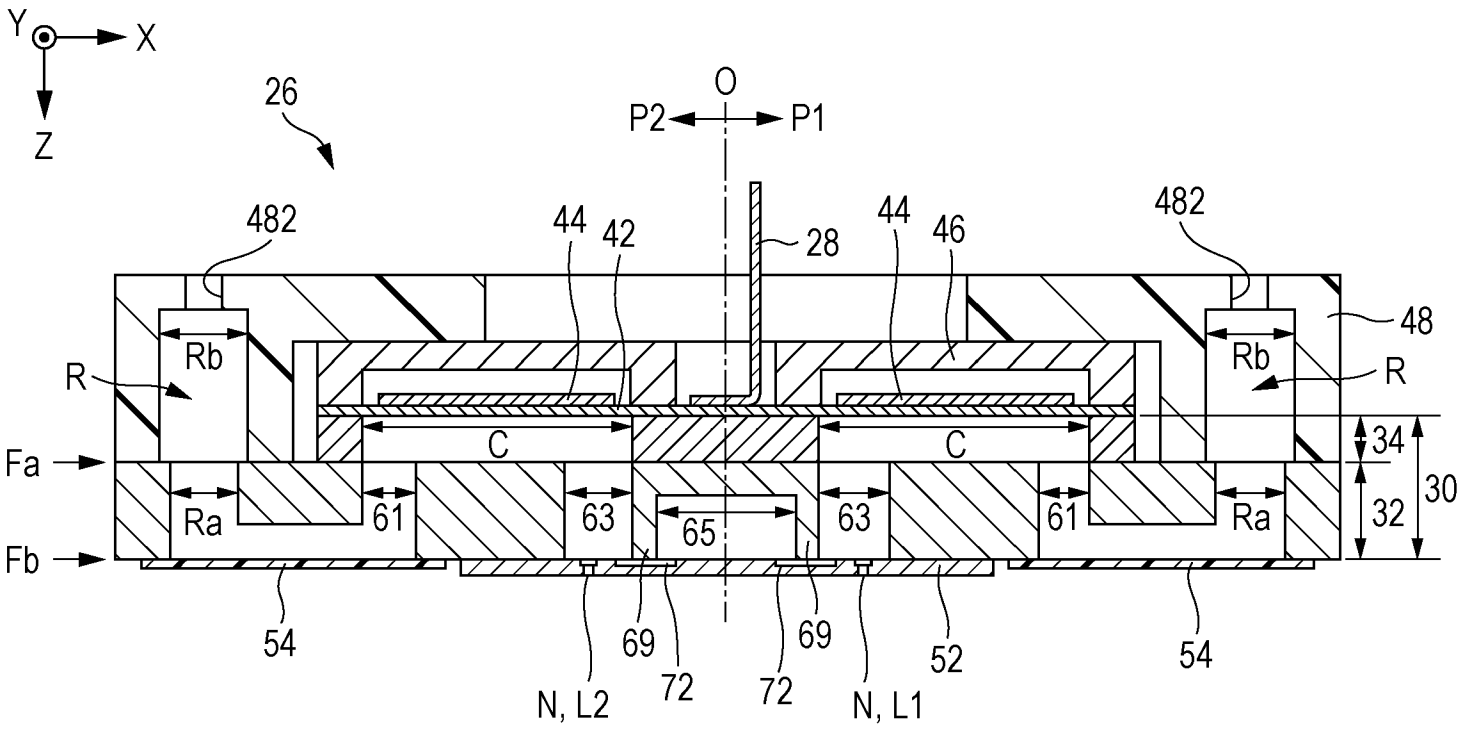
FIG. 2 is a schematic sectional view of an ink jet head used in an embodiment of the present disclosure.

As illustrated in FIG. 1, a plurality of nozzles N of the ink jet head 26 are aligned in the Y direction. Such alignments of the nozzles N are defined as a first line L1 and a second line L2 and arranged with a distance therebetween. The first line L1 and the second line L2 are each a group of nozzles linearly arranged in the Y direction. In an embodiment, the nozzles of either the first line L1 or the second line L2 may be shifted in the Y direction with respect to the other line, for example, in a staggered manner or a staggered arrangement. The following description, however, illustrates an arrangement in which the nozzles of the first line L1 and the second line L2 are coincident in position in the Y direction. In the following description, the plane that passes through the central axis parallel to the Y direction of the ink jet head 26 and that is parallel to the Z direction, that is, the Y-Z plane of the ink jet head 26, is referred to as the "central plane O". FIG. 2 is a sectional view of the ink jet head 26 taken in a direction perpendicular to the Y direction. As illustrated in FIG. 2, the ink jet head 26 has nozzles N (first nozzles) in a first line L1 and nozzles N (second nozzles) in a second line L2, and components or members associated with the nozzles N in the first line L1 and components or members associated with the nozzles N in the second line L2 are symmetrically arranged with respect to the central plane O. The portion of the ink jet head 26 on the positive side of the central plane O in the X-direction (hereinafter referred to as a first portion P1), and the portion on the negative side in the X direction (hereinafter referred to as a second portion P2) have substantially the same structure. The nozzles N in the first line L1 are formed in the first portion P1, and the nozzles N in the second line L2 are formed in the second portion P2. The central plane O is the boundary between the first portion P1 and the second portion P2.

In a serial ink jet printing apparatus, printing is performed by a plurality of times of scanning operation and a plurality of times of sub-scanning operation one after another. The scanning operation is performed by ejecting a composition from the ink jet head while moving in the X direction (scanning direction), and the sub-scanning operation is performed by transporting the printing medium in the Y direction (sub-scanning direction). For example, the scanning and the transport are alternately repeated. The scanning may be referred to as main scanning.

In an embodiment in which a coloring ink composition is ejected through the nozzles in the first line L1 and a non-coloring composition is ejected through nozzles in the second line L2, and in which the projections of the first line L1 and the second line L2 upon a plane in a main scanning direction have a coincidence portion along the sub-scanning direction, as illustrated in FIG. 1, the application steps of the coloring ink composition and the non-coloring composition are simultaneously performed.

In contrast, in an embodiment in which the first line L1 is arranged upstream in the sub-scanning direction from the second line L2 (at the upper side in FIG. 1), the coloring ink composition is applied before the application of the non-coloring composition. Also, in an embodiment in which the first line L1 is arranged downstream in the sub-scanning direction from the second line L2 (at the lower side in FIG. 1), the coloring ink composition is applied after the application of the non-coloring composition.

The ink jet head 26 shown in FIG. 2 has a flow path portion 30. The flow path portion 30 is a structure in which flow paths through which the compositions are fed to the plurality of nozzles N are formed. In the illustrated embodiment, the flow path portion 30 includes two layers: a first flow path substrate 32 (communication plate) and a second flow path substrate (pressure chamber plate) 34. The first flow path substrate 32 and the second flow path substrate 34 are each a plate member that is long in the Y direction. The second flow path substrate 34 is disposed with, for example, an adhesive on the surface Fa of the first flow path substrate 32 on the negative side in the Z direction.

As illustrated in FIG. 2, the first flow path substrate 32 is provided, at the surface Fa thereof, with a vibration member 42, a plurality of piezoelectric elements 44, a protection member 46, and a housing 48, in addition to the second flow path substrate 34. On the positive side in the Z direction of the first flow path substrate 32, that is, on the surface Fb opposite the surface Fa, a nozzle plate 52 and a vibration absorber 54 are disposed. The members of the ink jet head 26 are generally long in the Y direction as well as the first flow path substrate 32 and the second flow path substrate 34 and are bonded together with, for example, an adhesive. The Z direction may be considered to be the direction in which the first flow path substrate 32 and the second flow path substrate 34 are stacked, the direction in which the first flow path substrate 32 and the nozzle plate are stacked, or the direction perpendicular to the surfaces of various plate members.

The nozzle plate 52 is a plate member having a plurality of nozzles N (ejection openings) therein and is disposed on the surface Fb of the first flow path substrate 32 with, for example, an adhesive therebetween. Each of the nozzles N is a circular through-hole through which a composition passes. The nozzle plate 52 has nozzles N defining the first line L1 and nozzles N defining the second line L2. More specifically, the nozzles N in the first line L1 are aligned in the Y direction on the positive side in the X direction of the nozzle plate 52 with respect to the central plane O, and the nozzles N in the second line L2 are aligned in the Y direction on the negative side in the X direction of the nozzle plate 52. The nozzle plate 52 is a continuous one-piece plate member having both the nozzles N in the first line L1 and the nozzles N in the second line L2. The nozzle plate 52 is formed of a monocrystalline silicon (Si) substrate by a semiconductor processing technology, such as dry etching or wet etching. The nozzle plate 52 may be formed by using any other known material and process.

As illustrated in FIG. 2, the first flow path substrate 32 has a space Ra, a plurality of feed paths 61, and a plurality of communication paths 63 in both the first portion P1 and the second portion P2. The space Ra is an opening having a rectangular shape that is long in the Y direction when viewed from above (when viewed in the Z direction), and the feed paths 61 and the communication paths 63 are through-holes formed for the individual nozzles N. The communication paths 63 are aligned in the Y direction when viewed from above, and the feed paths 61 are aligned in the Y direction between the alignment of the communication paths 63 and the space Ra. The feed paths 61 communicate with and share the space Ra. Any one of the communication paths 63 is coincident in position with the corresponding nozzle N when viewed from above. More specifically, any one of the communication paths 63 in the first portion P1 communicates with the corresponding nozzle N in the first line L1. Similarly, any one of the communication paths 63 in the second portion P2 communicates with the corresponding nozzle N in the second line L2.

As illustrated in FIG. 2, the second flow path substrate 34 is a plate member having a plurality of pressure chambers C in each of the first portion P1 and the second portion P2. The pressure chambers C in each portion are arranged in the Y direction. The pressure chambers C (cavities) are provided one for each nozzle N and are each a space that is long in the X direction when viewed from above. As with the nozzle plate 52, the first flow path substrate 32 and the second flow path substrate 34 are, for example, formed of a monocrystalline silicon substrate by a semiconductor processing technology. The first flow path substrate 32 and the second flow path substrate 34 may be formed by using any other known material and process. In the disclosed embodiment, the flow path portion 30 (the first flow path substrate 32 and the second flow path substrate 34) and the nozzle plate 52 include a substrate made of silicon, as described above. Silicon substrates are beneficial in forming the flow path portion 30 and nozzle plate 52 having fine and precise flow paths by semiconductor processing.

As illustrated in FIG. 2, the second flow path substrate 34 is provided with a vibration member 42 on the surface thereof opposite the first flow path substrate 32. The vibration member 42 is an elastic plate (vibration plate) capable of vibrating. In an embodiment, the second flow path substrate 34 and the vibration member 42 may be formed in a one-piece body whose thickness is selectively reduced corresponding to the positions of the pressure chambers C.

As known from FIG. 2, the surface Fa of the first flow path substrate 32 and the vibration member 42 oppose each other with the spaces of the pressure chambers C therebetween. The pressure chambers C, which are spaces formed between the surface Fa of the first flow path substrate 32 and the vibration member 42, cause a composition in the spaces to vary in pressure. The pressure chambers C are each a space that is, for example, long in the X direction and are formed individually, one for each nozzle N. The pressure chambers C are arranged in the Y direction for each of the first line L1 and the second line L2. As illustrated in FIG. 2, one end adjacent to the central plane O of any one of the pressure chambers C is aligned with the corresponding communication path 63 when viewed from above, and the other end, remote from the central plane O, is aligned with the corresponding feed path 61 when viewed from above. Thus, the pressure chambers C communicate with the nozzles N through the communication paths 63 and communicate with the space Ra through the feed paths 61 in each of the first portion P1 and the second portion P2. In an embodiment, partially narrowed flow paths may be formed in the pressure chambers C to give the composition a predetermined flow resistance.

A plurality of piezoelectric elements 44 are provided on the surface of the vibration member 42 opposite the pressure chambers C for the individual nozzles N in each of the first portion P1 and the second portion P2, as illustrated in FIG. 2. The piezoelectric elements 44 are passive elements that deform according to the driving signals transmitted thereto. The piezoelectric elements 44 are arranged in the Y direction, corresponding to the pressure chambers C. Any one of the piezoelectric elements 44 is a multilayer composite including a first electrode 441 and a second electrode 442 with a piezoelectric layer 443 therebetween, as illustrated in FIG. 4. One of the first electrode 441 and the second electrode 442 may be a continuous electrode across the plurality of piezoelectric elements 44, that is, a common electrode shared by the piezoelectric elements 44. The portions in which the first electrode 441, the second electrode 442, and the piezoelectric layer 443 lie on each other act as the piezoelectric elements 44. Alternatively, portions that deform according to the driving signals transmitted thereto, that is, active portions that vibrate the vibration member 42, may define piezoelectric elements 44. The description up to here suggests that the ink jet head 26 includes first piezoelectric elements and second piezoelectric elements. For example, the first piezoelectric elements 44 are arranged on one side in the X direction with respect to the central plane O (for example, on the right side in FIG. 2), and the second piezoelectric elements 44 are arranged on the other side with respect to the central plane O (for example, on the left side in FIG. 2). When the deformation of the piezoelectric elements 44 causes the vibration member 42 to vibrate, the pressure in the pressure chambers C varies, and thus, the ink in the pressure chambers C is ejected through the communication paths 63 and the nozzles N.

The protection member 46 shown in FIG. 2 is a plate member adapted to protect the plurality of piezoelectric elements 44 and is disposed on the surface of the vibration member 42 or the surface of the second flow path substrate 34. The protection member 46 may be formed of any material by any method but may be formed in the same manner as in the case of the first flow path substrate 32 and the second flow path substrate 34, for example, by semiconductor processing of a monocrystalline silicon (Si) substrate. The piezoelectric elements 44 are accommodated in recesses formed in the surface, adjacent to the vibration member 42, of the protection member 46.

A terminal of a wiring board 28 is joined to the surface, opposite the flow path portion 30, of the vibration member 42 or to the surface of the flow path portion 30. The wiring board 28 is a flexible component having a plurality of conducting wires (not shown) that electrically couple the control unit 20 to the ink jet head 26. A terminal of the wiring board 28 is extracted through an opening of the protection member 46 and an opening of the housing 48 and coupled to the control unit 20. The wiring board 28 may be, for example, a flexible printed circuit (FPC) or a flexible flat cable (FFC).

The housing 48 is a case adapted to hold the composition to be fed to the pressure chambers C (and further to the nozzles N). The surface of the housing 48 on the positive side in the Z direction is bonded to the surface Fa of the first flow path substrate 32 with, for example, an adhesive. The housing 48 may be formed by using any known material and process. For example, the housing 48 may be formed by injection molding of a resin material.

As illustrated in FIG. 2, the housing 48 has a space Rb in each of the first portion P1 and the second portion P2. The space Rb of the housing 48 and the space Ra of the first flow path substrate 32 communicate with each other. The space Ra and the space Rb define a space that acts as a liquid reservoir R from which a composition is fed to the pressure chambers C. The liquid reservoir R is a common ink chamber shared by the plurality of nozzles N. Each of the first portion P1 and the second portion has the liquid reservoir R. The liquid reservoir R in the first portion P1 is located on the positive side in the X direction with respect to the central plane O, and the liquid reservoir R in the second portion P2 is located on the negative side in the X direction with respect to the central plane O. The housing 48 has inlets 482 in the surface thereof opposite the first flow path substrate 32. The composition fed from a liquid container 14 is introduced into the liquid reservoirs R through the respective inlets 482.

As illustrated in FIG. 2, a vibration absorber 54 is disposed on the surface Fb of the first flow path substrate 32 in each of the first portion P1 and the second portion P2. The vibration absorber 54 is a flexible film that reduces pressure changes of the composition in the liquid reservoir R, thus being a compliance substrate. As illustrated in FIG. 2, the vibration absorber 54 may be disposed, for example, on the surface Fb of the first flow path substrate 32 to close the space Ra and feed paths 61 of the first flow path substrate 32, thus defining a wall, more specifically, the bottom, of the reservoir R.

As illustrated in FIG. 2, the first flow path substrate 32 has a space (hereinafter referred to as a liquid circulation chamber) 65 in the surface Fb thereof opposing the nozzle plate 52. The liquid circulation chamber 65 of the illustrated embodiment is defined by an opening (ditch) with a bottom that is long in the Y direction when viewed from above. The open end of the liquid circulation chamber 65 is closed by the nozzle plate 52 joined to the surface Fb of the first flow path substrate 32.

Figure 3:
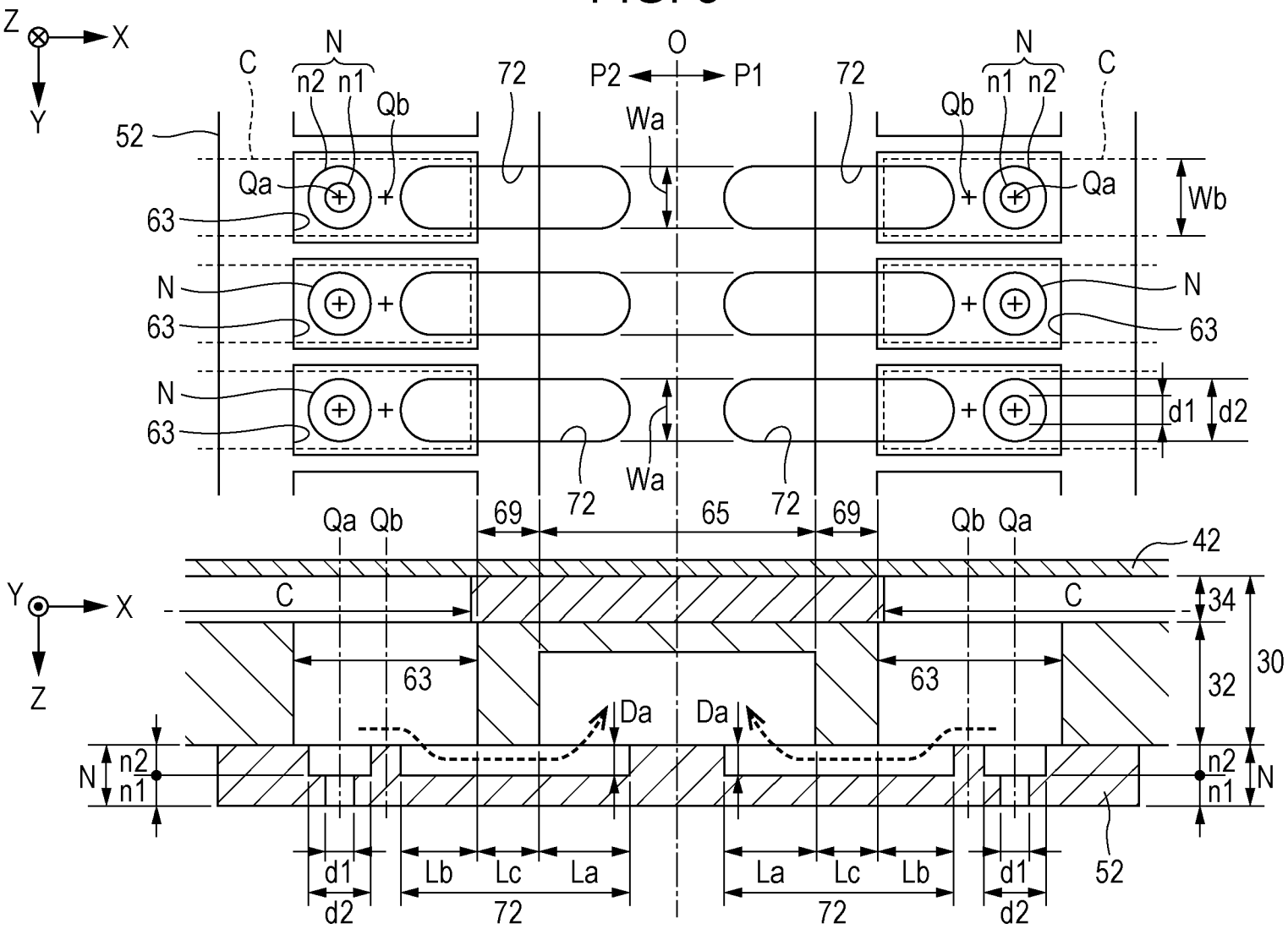
FIG. 3 is an illustrative representation including a plan view and a sectional view of a liquid circulation chamber and the vicinity thereof of the ink jet head used in an embodiment of the present disclosure.

FIG. 3 illustrates fragmentary enlarged plan and sectional views of the circulation chamber 65 and the vicinity thereof of the ink jet head 26. As illustrated in FIG. 3, the individual nozzles N have a first zone n1 and a second zone n2. The first zone n1 and the second zone n2 are coaxial circular spaces communicating with each other. The second zone n2 is closer than the first zone n1 to the flow path portion 30. The inner diameter d2 of the second zone n2 is larger than the inner diameter d1 of the first zone n1 (d2>d1). Nozzles N in such a step form are advantageous for controlling the flow resistance in each nozzle N as desired. The central axis Qa of each nozzle N is opposite to the liquid circulation chamber 65 with respect to the central axis Qb of the communication path 63, as illustrated in FIG. 3.

As illustrated in FIG. 3, the nozzle plate 52 is provided in each of the first portion P1 and the second portion P2 with a plurality of circulation paths 72 in the surface thereof opposing the flow path portion 30. The circulation paths 72 in the first portion P1 (an exemplification of first circulation paths) correspond one-to-one to the nozzles N in the first line L1 or the communication paths 63 corresponding to the first line L1. The circulation paths 72 in the second portion P2 (an exemplification of second circulation paths) correspond one-to-one to the nozzles N in the second line L2 or the communication paths 63 corresponding to the second line L2.

Each circulation path 72 is a ditch, or opening with a bottom, that is long in the X direction, functioning as a flow path through which a composition flows. The circulation path 72 has a distance from the corresponding nozzle N and is closer than this nozzle N to the liquid circulation chamber 65. The circulation paths 72 are formed by, for example, a process using semiconductor technology, such as dry etching or wet etching, together with the nozzles N, particularly the second zones n2, in the same process at one time.

Each circulation path 72 is linear and has a width Wa equal to the inner diameter d2 of the second zone n2 of the nozzle N, as illustrated in FIG. 3. The width Wa of the circulation path 72, which is the measurement in the Y direction of the circulation path 72, is smaller than the width Wb of the pressure chamber C that is the measurement in the Y direction of the pressure chamber C. This structure can increase the flow resistance in the circulation path 72 compared to the structure in which the width Wa of the circulation path 72 is larger than the width Wb of the pressure chamber C. The depth Da of the circulation path 72 from the surface of the nozzle plate 52 is constant throughout the length of the circulation path. More specifically, the circulation path 72 has a constant depth that is equal to the depth of the second zone n2 of the nozzle N. Such a structure is easy to form compared to the structure in which the circulation path 72 and the second zone n2 have different depths. The depth of a flow path refers to the measurement in the Z direction of the flow path, that is, the difference in level between the open end and the bottom of the flow path.

Any one of the circulation paths 72 in the first portion P1 lies closer than the corresponding nozzle N to the liquid circulation chamber 65. Also, any one of the circulation paths 72 in the second portion P2 lies closer than the corresponding nozzle N to the liquid circulation chamber 65. The end, remote from the central plane O (or adjacent to the communication path 63), of the circulation path 72 lies within the corresponding communication path 63 when viewed from above. Hence, the circulation path 72 communicates with the communication path 63. On the other side, the end adjacent to the central plane O (or at the ink circulation chamber 65) of the circulation path 72 lies within the liquid circulation chamber 65 when viewed from above. Hence, the circulation path 72 communicates with the liquid circulation chamber 65. As described above, each of the communication paths 63 communicates with the liquid circulation chamber 65 through the corresponding circulation path 72. Thus, the composition in each communication path 63 is fed to the liquid circulation chamber 65 through the circulation path 72, as indicated by the broken lines with an arrowhead in FIG. 3. In other words, the communication paths 63 corresponding to the nozzles N in the first line L1 and the communication paths 63 corresponding to the nozzles N in the second line L2 share and communicate with the single liquid circulation chamber 65.

In FIG. 3, any one of the circulation path 72 has a portion with a length La (in the X direction) overlapping with the liquid circulation chamber 65, a portion with a length Lb (in the X direction) overlapping with the communication path 63, and a portion with a length Lc (in the X direction) overlapping with the partition 69 of the flow path portion 30. Length Lc is equivalent to the thickness of the partition 69. The partition 69 acts as a throttle of the circulation path 72. Accordingly, the larger the length Lc or the thickness of the partition 69, the higher the flow resistance in the circulation path 72. Length La is larger than length Lb (La>Lb) and length Lc (La>Lc). In addition, length Lb is larger than length Lc (Lb>Lc). Hence, La>Lb>Lc holds true. In the structure described above, compositions can be easily introduced into the liquid circulation chamber 65 from the communication paths 63 through the circulation paths 72 compared to the structure in which length La and length Lb are shorter than length Lc.

The circulation paths 72 enable the coloring ink composition fed into a first ink jet head to circulate before the ejection through the ejection openings of the first ink jet head. In the ink jet head 26, compositions are fed through the respective inlets 482 and ejected through the nozzles N. On the assumption that the paths of a composition flowing from the inlet 482 to the nozzles N without circulation define a single main route, the circulation paths 72 diverge from the main route. A portion of the composition fed into the ink jet head diverges from the main route to flow into the liquid circulation chamber and returns to the main route through flow paths connected to the liquid circulation chamber 65. Thus, the composition is finally ejected through the nozzles N. The liquid circulation chamber 65 is connected to a further flow path through which the composition merges with the portion of the composition newly introduced to the flow path and returns to the main route. In an embodiment, for example, the further flow path may be provided outside the ink jet head, and the composition is discharged from the liquid circulation chamber 65 to the further flow path to merge with the portion of the composition newly introduced to the flow path and then fed into the ink jet head again through the inlet 482. In an alternative embodiment, the further flow path may be provided within the ink jet head so that the composition can be returned to the single rout through the further flow path.

Although the circulation paths 72 of the embodiment illustrated in FIG. 2 diverge from the main route at the communication paths 63, the circulation paths 72 may diverge from the main route at any position in the ink jet head. Beneficially, the circulation paths diverge from the main route at the pressure chamber or at positions downstream from the pressure chamber in the direction toward the nozzles.

The main route, the circulation paths 72, the liquid circulation chamber 65, and the further flow path connected to the liquid circulation chamber 65 define a channel through which a composition circulates. Such a circulation channel may be referred to as a circulation mechanism. The circulation mechanism may be optionally provided with a filter through which the composition is filtered, and/or a pump operable to cause the composition to flow, and a mechanism operable to heat the composition.

By circulating a composition through the circulation paths, the portion of the composition thickened by drying is thinned to resolve the degradation of ejection consistency. Also, if the composition cannot be consistently ejected due to contamination with dust, dirt, or air bubbles, the circulation can remove such contaminants. The circulation of the composition enhances ejection consistency and helps to improve image quality.

For the non-coloring composition, circulation through the circulation paths is not performed. The non-coloring composition is fed into another ink jet head (second ink jet head) and is then ejected through the ejection opening of the second ink jet head without circulation through any circulation path. In this instance, the circulation mechanism is not necessary. Such a printing apparatus can be light in weight and small, resulting in reduced costs. In addition, operations of a heating mechanism and a pump performed for the circulation can be omitted. Furthermore, problems resulting from the circulation do not occur.

Composition Heating Mechanism

The composition fed into the ink jet head may be heated with a heating mechanism before being ejected. Such a heating mechanism may be provided at a position from the liquid container holding the composition to the ink jet head, for example, in the ink jet head. The composition heating mechanism may be, but is not limited to, a film (not shown) tightly attached to a side adjacent to the surface having the ejection openings of the ink jet head 26. The heating film is operable to heat the ink jet head 26 and thus heat the coloring ink composition fed to the ink jet head 26. The heating film may be, for example, a sheet heater or the like that is a heating resistor sandwiched between resin sheets.

The composition heating mechanism may be provided upstream from the ink jet head and between the liquid container and the ink jet head. For example, the heating mechanism may be provided at a flow path through which a composition is fed to the ink jet head. Also, the composition heating mechanism may be provided at the circulation mechanism but outside the ink jet head.

Composition heating with the composition heating mechanism can reduce the viscosity of the composition, thereby increasing ejection consistency and image quality. Also, composition heating can keep the temperature of the composition constant, thus ensuring consistent ejection. From these viewpoints, it is beneficial to eject compositions heated to a temperature higher than room temperature with a composition heating mechanism.

In particular, the coloring ink composition heated with a composition heating mechanism can produce high image quality. Although composition heating is likely to dry and thicken the composition, such phenomena can be eliminated by circulating the composition. From this viewpoint, it is not beneficial to heat the non-coloring composition that is not to be circulated.

Coloring Ink Composition

The coloring ink composition used in the printing method disclosed herein is intended to color the printing medium. Hence, the coloring ink composition can color the printing medium and is not otherwise limited. The constituents of the coloring ink composition will be described below.

Coloring Material

The coloring ink composition used in the printing method disclosed herein may contain a coloring material. The coloring material may be a pigment. Examples of the pigment will be cited below.

A black in may contain a carbon black as a pigment, and examples thereof include, but are not limited to, No. 2300, No. 900, MCF 88, No. 33, No. 40, No. 45, No. 52, MA 7, MA 8, MA 100, and No. 2200B (all produced by Mitsubishi Chemical Corporation); Raven 5750, Raven 5250, Raven 5000, Raven 3500, Raven 1255, and Raven 700 (all produced by Carbon Columbia); Regal 400R, Regal 330R, Regal 660R, Mogul L, Monarch 700, Monarch 800, Monarch 880, Monarch 900, Monarch 1000, Monarch 1100, Monarch 1300, and Monarch 1400 (all produced by CABOT); and Color Black FW1, Color Black FW2, Color Black FW2V, Color Black FW18, Color Black FW200, Color Black 5150, Color Black 5160, Color Black 5170, Printex 35, Printex U, Printex V, Printex 140U, Special Black 6, Special Black 5, Special Black 4A, and Special Black 4 (all produced by Degussa).

Examples of the pigment used in a white ink include, but are not limited to, C.I. Pigment Whites 6, 18, and 21, titanium oxide, zinc oxide, zinc sulfide, antimony oxide, zirconium oxide, and white hollow resin or polymer particles.

Examples of the pigment used in a yellow ink include, but are not limited to, C.I. Pigment Yellows 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180.

Examples of the pigment used in a magenta ink include, but are not limited to, C.I. Pigment Reds 1, 2, 3, 4, 5, 6, 7, 8, 9, 10, 11, 12, 14, 15, 16, 17, 18, 19, 21, 22, 23, 30, 31, 32, 37, 38, 40, 41, 42, 48:2, 48:5, 57:1, 88, 112, 114, 122, 123, 144, 146, 149, 150, 166, 168, 170, 171, 175, 176, 177, 178, 179, 184, 185, 187, 202, 209, 219, 224, and 245; and C.I. Pigment Violets 19, 23, 32, 33, 36, 38, 43, and 50.

Examples of the pigment used in a cyan ink include, but are not limited to, C.I. Pigment Blues 1, 2, 3, 15, 15:1, 15:2, 15:3, 15:34, 15:4, 16, 18, 22, 25, 60, 65, and 66; and C.I. Vat Blues 4 and 60.

Other pigments may be used, and examples thereof include, but are not limited to, C.I. Pigment Greens 7 and 10, C.I. Pigment Browns 3, 5, 25, and 26, and C.I. Pigment Oranges 1, 2, 5, 7, 13, 14, 15, 16, 24, 34, 36, 38, 40, 43, and 63.

In some embodiments, the coloring material may be one or more pigments selected from the group consisting of self-dispersible pigments and polymer-dispersible pigments. Such coloring materials can be uniformly dispersed in the printed item, thereby increasing gloss.

Self-dispersible pigments have hydrophilic groups at the surfaces of the particles thereof. Such a hydrophilic group may be at least one chemical group selected from the group consisting of —OM, —COOM, —CO—, —$SO_3M$, —$SO_2M$, —$SO_2NH_2$, —$RSO_2M$, —$PO_3HM$, —$PO_3M_2$, —$SO_2NHCOR$, —$NH_3$, and —$NR_3$.

M in some of the above-cited groups represents a hydrogen atom, an alkali metal, ammonium, a substituted or unsubstituted phenyl group, or an organic ammonium, and R represents an alkyl group having a carbon number of 1 to 12, or a substituted or unsubstituted naphthyl group. M and R are each selected independently.

More specifically, a self-dispersible pigment may be prepared, for example, by physical treatment or chemical treatment to bind (graft) any of the above-cited hydrophilic groups to the surfaces of pigment particles. For the physical treatment, vacuum plasma treatment or the like may be performed. For the chemical treatment, pigment particles may be subjected to wet oxidation with an oxidizing agent in water to oxidize the surfaces thereof, or p-aminobenzoic acid may be bound to the surfaces of the pigment particles so that carboxy group is bound to the surfaces with the phenyl group therebetween.

Polymer-dispersible pigments are pigments that are made dispersible by a polymer. The proportion of the polymer to the pigment can be represented by the percentage (coverage) of the polymer covering the pigment particles to the pigment. The polymer coverage may be from 1.0% to 50%, for example, 1.0% to 10% or 1.0% to 5.0%. By controlling the polymer coverage to 1.0% or more, the pigment can be favorably dispersed. Also, by controlling the polymer coverage to 50% or less, the color developability of the pigment tends to be increased. In particular, when the polymer coverage is 5.0% or less, much higher color development can be achieved. The polymer to make a pigment dispersible is referred to as a dispersant resin.

The polymer may be an acrylic resin that is a copolymer containing 30% or more of a (meth)acrylic monomer, such as (meth)acrylate, (meth)acrylic acid, or (meth)acrylamide, relative to the total mass of the polymer. More beneficially, the proportion of the acrylic monomer in the acrylic resin may be 50% by mass or more or 70% by mass or more. The acrylic resin may contain monomers other than acrylic monomers, and the proportion of other monomers may be 70% by mass or less, for example, 50% by mass or less or 30% by mass or less.

Such a monomer other than acrylic monomers may be a vinyl monomer, such as styrene.

The use of an acrylic resin as the polymer or dispersant resin further increases the adhesion and the gloss of the ink composition. In some embodiments, the polymer may contain at least either an alkyl (meta)acrylate having a carbon number of 1 to 24 or a cyclic alkyl (meta)acrylate having a carbon number of 3 to 24 in a proportion of 70% by mass or more. Examples of such an alkyl (meta)acrylate or cyclic alkyl (meta)acrylate include methyl (meth)acrylate, ethyl (meth)acrylate, propyl (meth) acrylate, n-butyl (meth)acrylate, isobutyl (meth)acrylate, pentyl (meth)acrylate, hexyl (meth)acrylate, 2-ethylhexyl (meth)acrylate, octyl (meth) acrylate, nonyl (meth) acrylate, decyl (meth)acrylate, t-butylcyclohexyl (meth)acrylate, lauryl (meth)acrylate, isobornyl (meth)acrylate, cetyl (meth)acrylate, stearyl (meth) acrylate, isostearyl (meth)acrylate, tetramethylpiperidyl (meth)acrylate, dicyclopentanyl (meth)acrylate, dicyclopentenyl (meth)acrylate, dicyclopentenyloxy (meth)acrylate, and behenyl (meth)acrylate. In addition, other components may be contained, and examples thereof include hydroxy (meth)acrylates, such as hydroxyethyl (meth)acrylate, hydroxypropyl (meth)acrylate, and diethylene glycol (meth) acrylate; urethane (meth)acrylates; and epoxy (meth)acrylates. In the description of the present disclosure, a (meth) acrylate refers to both an acrylate and the corresponding methacrylate.

The coloring material content, in terms of solids, may be 0.1% to 50%, for example, 1.0% to 20%, 2.0% to 10%, or 3.0% to 8%, relative to the total mass of the coloring ink composition. When the coloring material content is in such a range, the color developability of the ink composition tends to increase. The term "total mass" mentioned herein represents 100% by mass.

Resin Particles

The coloring ink composition disclosed in the embodiments of the present disclosure contains resin particles (hereinafter, in some cases, referred to as "resin dispersion" or "resin emulsion"). The resin particles may be self-dispersible resin particles to which a hydrophilic component is added so as to disperse stably in water or may be capable of dispersing in water with an externally added emulsifier. The resin particles are anionic or nonionic.

Examples of the material of the resin particles include acrylic resin (or (meth)acrylic resin) including styrene-acrylic resin, urethane resin, epoxy resin, polyolefin resin (e.g. polyethylene resin), fluorene resin, rosin-modified resin, terpene resin, polyester resin, polyamide resin, vinyl chloride resin, vinyl chloride-vinyl acetate copolymer, and ethylene vinyl acetate resin. Beneficially, the resin particles are made of one or more materials selected from the group consisting of (meth)acrylic resin including styrene-acrylic resin, urethane resin, epoxy resin, and polyolefin resin. In some embodiments, the resin particles may be made of either urethane resin or styrene-acrylic resin or both. Such resins may be used individually or in combination.

In the description of the present disclosure, a (meth) acrylic substance refers to both an acrylic substance and the corresponding methacrylic substance. Also, the term "acrylic-based" refers to both methacrylic-based and acrylic-based. Hence, an acrylic resin or acrylic-based resin is a resin containing an acrylic monomer or a methacrylic monomer.

The urethane resin may be a polyether-type urethane resin having an ether bond as well as the urethane bond in the main chain, a polyester-type urethane resin having an ester bond as well as the urethane bond in the main chain, or a polycarbonate-type urethane resin having a carbonate linkage as well as the urethane bond in the main chain. In some embodiments, polyester-type urethane resin containing an ester bond in the main chain may be used. Such urethane resins may be used individually or in combination.

A commercially available urethane resin may be used, and examples thereof include UW-1501F and UW-5002 (both produced by Ube Industries); W-6061 and W-6110 (both produced by Mitsui Chemicals); and UX-150, UX-390, and UX-200 (all produced by Sanyo Chemical Industries).

The styrene-acrylic resin may be a copolymer of any of the above-cited monomers used in (meth)acrylic resin and an aromatic vinyl monomer, such as styrene, α-methylstyrene, vinyltoluene, 4-t-butylstyrene, chlorostyrene, vinylanisole, or vinylnaphthalene. A known such a styrene-acrylic resin may be used.

The resin particle content, in terms of solids, may be 0.1% to 20%, for example, 0.5% to 15% or 1.0% to 10%, relative to the total mass of the coloring ink composition. In some embodiments, the resin particle content may be 6% by mass or less or 5% by mass or less. When the resin particle content is in such a range, the coloring ink composition can be ejected consistently and produce printed items having a high abrasion resistance.

Wax

The coloring ink composition used in the embodiments of the present disclosure may further contain a wax. The use of a wax tends to increase the abrasion resistance of the printed item.

Examples of the wax include, but are not limited to, calcium stearate, ammonium stearate, microcrystalline wax, polyethylene wax, paraffin wax, and polyethylene-paraffin wax. A commercially available wax may be used, and examples thereof include AQUACER 497 and AQUACER 507 (both produced by BYK) and Michem Emulsion 85250 (produced by Michelman). In some embodiments, a polyethylene-base compound, such as polyethylene wax, polyethylene-paraffin wax, and Michem Emulsion 85250, may be used. Such waxes may be used individually or in combination. The wax is anionic or nonionic.

The wax content, in terms of solids, may be 0.1% to 10%, for example, 0.5% to 5.0% or 0.8% to 3.0%, relative to the total mass of the coloring ink composition. When the wax content is in such a range, the coloring ink composition tends to produce printed items having a high abrasion resistance.

Beneficially, the coloring ink composition contains at least either resin particles or a wax, and the total content by mass of resin particles and waxes in the coloring ink composition is lower than that in the non-coloring composition. In some embodiments, the total content of resin particles and waxes may be less than 6.5%, for example, less than 6%, relative to the total mass of the coloring ink composition. The lower limit of such a total content may be, by mass, 0.5% or more, for example, 1% or more or 3% or more.

Organic Solvent

The coloring ink composition used in the embodiments of the present disclosure may contain an organic solvent. The organic solvent in the coloring ink composition helps the coloring ink composition on the printing medium to dry rapidly. Thus, the resulting printed item tends to exhibit high abrasion resistance and high image quality.

Examples of the organic solvent include, but are not limited to, nitrogen-containing solvents, aprotic polar solvents, monoalcohols, alkyl polyols, and glycol ethers.

In some embodiments, at least either a nitrogen-containing solvent or an aprotic polar solvent may be used. The nitrogen-containing solvent or the aprotic polar solvent in the coloring ink composition can reduce the apparent glass transition temperature of the resin particles so that the core polymer and the shell polymer of the resin particles can soften at a lower temperature than usual. Consequently, the coloring ink composition becomes likely to fix favorably to the printing medium. Thus, the fixability of the coloring ink composition to the printing medium can be increased, particularly when the printing medium is made of polyvinyl chloride.

The aprotic polar solvent may be, but is not limited to, a cyclic ketone or a chain ketone. Other aprotic polar solvents may be used, and such a solvent may be derived from pyrrolidone, imidazolidinone, sulfoxide, lactone, or amide ether. More specifically, beneficial examples of such a solvent include 2-pyrrolidone, N-alkyl-2-pyrrolidone (e.g. N-methylpyrrolidone), 1-alkyl-2-pyrrolidone, γ-butyrolactone, 1,3-dimethyl-2-imidazolidinone, dimethyl sulfoxide, imidazole, 1-methylimidazole, 2-methylimidazole, and 1,2-dimethylimidazole.

The nitrogen-containing solvent may be an amide having a cyclic structure, such as pyrrolidone, or an acyclic amide.

Examples of the acyclic amide include, but are not limited to, N,N-dialkylpropionamides, such as 3-butoxy-N,N-dimethylpropionamide and 3-methoxy-N,N-dimethylpropionamide.

Exemplary monoalcohols include, but are not limited to, methanol, ethanol, n-propyl alcohol, isopropyl alcohol, n-butyl alcohol, 2-butanol, tert-butyl alcohol, isobutyl alcohol, and n-pentyl alcohol, 2-pentanol, 3-pentanol, and tert-pentyl alcohol.

Exemplary alkyl polyols include, but are not limited to, glycerin, ethylene glycol, diethylene glycol, triethylene glycol, propylene glycol (1,2-propanediol), dipropylene glycol, 1,3-propylene glycol (1,3-propanediol), isobutylene glycol (2-methyl-1,2-propanediol), 1,2-butanediiol, 1,3-butanediol (1,3-butylene glycol), 1,4-butanediol, 2-butene-1,4-diol, 1,2-pentanediol, 1,5-pentanediol, 2-methyl-2,4-pentanediol, 1,2-hexanediol, 1,6-hexanediol, 2-ethyl-1,3-hexanediol, 1,7-butanediiol, and 1,8-octanediol. Alkyl polyols having a carbon number of 2 to 8 and alkyl polyols having 2 or 3 hydroxy groups are beneficial. A coloring ink composition containing an alkyl polyol can be consistently ejected and can produce printed times having high abrasion resistance and image quality.

Exemplary glycol ethers include, but are not limited to, diethylene glycol mono-n-propyl ether, ethylene glycol monoisopropyl ether, diethylene glycol monoisopropyl ether, ethylene glycol mono-n-butyl ether, ethylene glycol mono-t-butyl ether, diethylene glycol mono-n-butyl ether, triethylene glycol monobutyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol monoisopropyl ether, propylene glycol mono-n-butyl ether, dipropylene glycol monomethyl ether, dipropylene glycol mono-n-butyl ether, dipropylene glycol mono-n-propyl ether, and dipropylene glycol monoisopropyl ether. Glycol ethers having a carbon number of 3 to 10 are beneficial. In an embodiment, the glycol ether may be an ether with an alkyl group having a carbon number of 4 or less. Also, the glycol ether may be a monoether. A coloring ink composition containing a glycol ether can be consistently ejected and can produce high image quality.

The organic solvent content may be 1.0% to 80%, for example, 5.0% to 60% or 10% to 40%, relative to the total mass of the coloring ink composition. When the organic solvent content is 80% by mass or less, the coloring ink composition tends to dry more rapidly. When the organic solvent content is 3.0% by mass or more, the coloring ink composition tends to be more consistently ejected.

The organic solvent may have a normal boiling point of 170° C. to 280° C. In an embodiment, an organic solvent having a normal boiling point of 180° C. to 260° C. may be used. In some embodiments, the content, by mass, of organic solvents having a normal boiling point of more than 280° C. in the coloring ink composition may be limited to 1% or less, for example, 0.5% or less or 0.1% or less. In an embodiment, the content of such organic solvents may be 0%.

Surfactant

The coloring ink composition may contain a surfactant. The surfactant in the coloring ink composition tents to increase image quality. The surfactant may be, but is not limited to, an acetylene glycol-based surfactant, a fluorosurfactant, or a silicone surfactant. In some embodiments, a fluorosurfactant or a silicone surfactant may be used.

Examples of the fluorosurfactant include, but are not limited to, perfluoroalkylsulfonic acid salts, perfluoroalkylcarboxylic acid salts, perfluoroalkylphosphoric acid esters, perfluoroalkylethylene oxide adducts, perfluoroalkylbetaines, and perfluoroalkylamine oxide compounds. Fluorosurfactants are commercially available, and examples thereof include, but are not limited to, MF410 (perfluoroalkyl-containing carboxylic acid salt produced by DIC); S-144 and S-145 (both produced by Asahi Glass); FC-170C, FC-430, and Fluorad-FC4430 (all produced by Sumitomo 3M); FSO, FSO-100, FSN, FSN-100, and FS-300 (all produced by Dupont); and FT-250 and FT-251 (both produced by Neos). A fluorosurfactant may be used alone, or a plurality of fluorosurfactants may be used in combination.

The silicone surfactant may be, but is not limited to, a polysiloxane compound or a polyether-modified organosiloxane. The silicone surfactant is commercially available, and examples thereof include, but are not limited to, BYK-306, BYK-307, BYK-333, BYK-341, BYK-345, BYK-346, BYK-347, BYK-348, and BYK-349 (all produced by BYK); and KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (all produced by Shin-Etsu Chemical). A silicone surfactant may be used alone, or a plurality of silicone surfactants may be used in combination.

The acetylene glycol-based surfactant may have an acetylene skeleton having two hydroxy groups. In such an acetylene glycol-based surfactant, the two hydroxy groups may be introduced to the acetylene skeleton with an organic group therebetween. The organic group may be a polyoxyalkylene group.

The surfactant content, in terms of solids, may be 0.1% to 10%, for example, 0.5% to 5.0% or 1.0% to 3.0%, relative to the total mass of the coloring ink composition. When the surfactant content is in such a range, the coloring ink composition tends to wet favorably the printing medium and spread sufficiently and can be ejected consistently produce high image quality.

Antifoaming Agent

In an embodiment, the coloring ink composition may contain an antifoaming agent. The antifoaming agent in the coloring ink composition removes bubbles from the coloring ink composition, thus helping consistent ejection of the coloring ink composition. The antifoaming agent may be, but is not limited to, a polyoxyalkylene alkyl ether-based surfactant or an acetylene glycol-based surfactant.

The polyoxyalkylene alkyl ether-based surfactant may be, but is not limited to, a polyoxyethylene alkyl ether. The polyoxyethylene alkyl ether-based surfactant may be a commercial product DW800 (polyoxyethylene alkyl ether group-containing surfactant produced by BYK). A polyoxyethylene alkyl ether-based surfactant may be used alone, or a plurality of polyoxyethylene alkyl ether surfactants may be used in combination.

The acetylene glycol-based surfactant may be, but is not limited to, at least one selected from the group consisting of 2,4,7,9-tetramethyl-5-decyne-4,7-diol and alkylene oxide adducts thereof, and 2,4-dimethyl-5-decyne-4-ol and alkylene oxide adducts thereof. The acetylene glycol-based surfactant is commercially available, and examples of thereof include, but are not limited to, Olfine 104 series and Olfine E series, such as Olfine E1010 (all produced by Air Products and Chemicals Inc.); and Surfynol series 104, 465, 61, and DF110D (all produced by Nissin Chemical Industry). An acetylene glycol-based surfactant may be used individually, or a plurality of acetylene glycol-based surfactants may be used in combination.

The antifoaming agent content, in terms of solids, may be 0.01% to 10%, for example, 0.1% to 1.0% or 0.15% to 0.5%, relative to the total mass of the coloring ink composition. When the surfactant content is in such a range, the coloring ink composition tends to be consistently ejected and to produce high image quality.

Beneficially, the coloring ink composition contains at least either a surfactant or an antifoaming agent, and the total content of surfactants and antifoaming agents in the coloring ink composition on a mass basis is lower than that in the non-coloring composition. In some embodiments, the total content of surfactants and antifoaming agents may be less than 1.5%, for example, 1.2% or less, relative to the total mass of the coloring ink composition. Also, the lower limit of such a total content may be 0.5% by mass or more or 1.0% by mass or more.

Water

The coloring ink composition used in the embodiments of the printing disclosure may contain water. The water may be pure water or ultra-pure water from which ionic impurities have been removed as much as possible. Examples of such water include ion exchanged water, ultrafiltered water, reverse osmosis water, and distilled water. Sterile water prepared by, for example, UV irradiation or addition of hydrogen peroxide may be used. The use of sterile water can prevent, for a long period, the occurrence of mold or bacteria in the composition. Thus, the coloring ink composition can be stably stored. The water content in the coloring ink composition may be, by mass, 30% or more, for example, 40% or more, 50% or more, or 60% or more. The upper limit of the water content may be, but is not limited to, 95% by mass or less.

The coloring ink composition used in the embodiments of the present disclosure may be aqueous. Aqueous in relation to a composition denotes a composition containing water as one of the major constituents, and an aqueous composition contains 30% by mass or more of water. Aqueous compositions are environmentally friendly, less toxic, and safe and are therefore beneficial.

The coloring ink composition may optionally contain other constituents or additives, such as a solubilizing agent, a viscosity modifier, a pH adjuster, an antioxidant, a preservative, an antifungal agent, a corrosion inhibitor, and a chelating agent (e.g. sodium ethylenediaminetetraacetate) for trapping metal ions affecting dispersion.

Non-Coloring Composition

The non-coloring composition used in the printing method disclosed herein is not intended to color the printing medium and is a composition other than the above-described coloring ink composition. The non-coloring composition may be a clear ink composition containing at least one material of resin particles and a wax, which have been described above, or a treatment liquid containing a flocculant functioning to flocculate one or more constituents of the above-described coloring ink composition. Such a non-coloring composition is beneficial from the viewpoint of increasing abrasion resistance and producing high image quality.

The non-coloring composition may contain constituents as used in the coloring ink composition, such as resin particles, a wax, an organic solvent, a surfactant, an antifoaming agent, and water, independent of the coloring ink composition. Such constituents may be the same as those used in the coloring ink composition except for the coloring material. The non-coloring composition may optionally contain other constituents or additives, such as a solubilizing agent, a viscosity modifier, a pH adjuster, an antioxidant, a preservative, an antifungal agent, a corrosion inhibitor, and a chelating agent for trapping metal ions affecting dispersion. Since the non-coloring composition is not intended to color the printing medium, the coloring material content is beneficially 0.1% or less, for example, 0.05% or less or 0.01% or less, relative to the total mass of the non-coloring composition. In some embodiments, the coloring material content may be 0% by mass. As with the coloring ink composition, the non-coloring composition may be aqueous.

The non-coloring composition may be at least any one of the following (1) to (3):

(1) a non-coloring composition containing at least either resin particles or a wax, in which the total content by mass of resin particles and waxes is higher than the total content of resin particles and waxes in the coloring ink composition;

(2) a non-coloring composition containing at least either a surfactant or an antifoaming agent, in which the total content by mass of surfactants and antifoaming agents is higher than the total content of surfactants and antifoaming agents in the coloring ink composition; and (3) a non-coloring composition being a treatment liquid and containing a flocculant functioning to flocculate the coloring ink composition, and resin particles or a wax.

In some embodiments, the non-coloring composition contains at least either resin particles or a wax, and the total content by mass of resin particles and waxes is higher than the total content of resin particles and waxes in the coloring ink composition.

Alternatively, the non-coloring composition may contain at least either resin particles or a wax, and the total content of resin particles and waxes is 2.0% or more, for example, 5.0% or more or 6.5% or more, relative to the total mass of the non-coloring composition. In an embodiment, the total content of resin particles and waxes may be, by mass, 7% or more, for example, 8% or more or 9% or more. Also, such a total content may be, by mass, 20% or less, for example, 15% or less or 12% or less. Beneficially, the total content of resin particles and waxes may be, by mass, 10% or less, for example, 5% or less or 4% or less.

When the total content of resin particles and waxes is in such a range, the resulting printed item has high abrasion resistance. When the total content of resin particles and waxes is in such a range, it is not beneficial to circulate the non-coloring composition through any circulation path, in view of ejection consistency and filter lifetime. This is because circulation destabilizes the dispersion of resin or wax particles. Also, if a gas-liquid interface is formed by circulation in the circulation path, resin particles or waxes form undesired foreign matter at the interface. When the total content of resin particles and waxes is in the above range or lower, the non-coloring composition is beneficial in terms of ejection consistency and filter lifetime. The non-coloring composition may be a clear ink to increase abrasion resistance.

Also, not only when the total content of resin particles and waxes is in the above range, but also when it is higher than the total content by mass of the resin particles and waxes in the coloring ink composition, the non-coloring composition tends to form a coating with a higher abrasion resistance than the coloring ink composition. If such a non-coloring composition is circulated, the non-coloring composition tends to exhibit unsatisfactory ejection consistency and reduce filter lifetime, compared to the coloring ink composition. Accordingly, it is not beneficial to circulate the non-coloring composition.

The resin particle content in the non-coloring composition may be 2% or more, for example, 5% or more or 7% or more, relative to the total mass of the non-coloring composition. Also, the upper limit of the resin particle content may be, by mass, 20% or less, for example, 15% or less or 10% or less.

The wax content in the non-coloring composition may be 0.5% or more, for example, 1% or more or 2% or more, relative to the total mass of the non-coloring composition. Also, the upper limit of the wax content may be, by mass, 5% or less, for example, 4% or less or 3% or less.

In some embodiments, the non-coloring composition contains at least either a surfactant or an antifoaming agent, and the total content by mass of surfactants and antifoaming agents is higher than the total content of surfactants and antifoaming agents in the coloring ink composition.

Alternatively, the non-coloring composition may contain at least either a surfactant or an antifoaming agent, and in which the total content of surfactants and antifoaming agents is 0.5% or more, for example, 1.0% or more or 1.5% or more, relative to the total mass of the non-coloring composition. In an embodiment, the total content of surfactants and antifoaming agents may be, by mass, 1.8% or more or 2% or more. Also, the upper limit of the total content of surfactants and antifoaming agents is not limited but may be, by mass, 5% or less, for example, 4% or less or 3% or less. In an embodiment, it may be 2% or less or 1.5% or less.

When the total content of surfactants and antifoaming agents is any of the above-cited values or higher, the non-coloring composition can satisfactorily wet the printing medium and spread sufficiently, thus helping to produce high image quality. Such a total content of surfactants and antifoaming agents is beneficial also for consistent ejection from the ink jet head. When the non-coloring composition is a treatment liquid, the treatment liquid with such a total content enables the flocculant to wet the printing medium and spread sufficiently and react with the coloring ink composition, thus producing high image quality. Accordingly, in such an instance, it is beneficial to control the total content of surfactants and antifoaming agents to any of the above-cited values or higher. In view of ejection consistency and filter lifetime, however, the total content of surfactants and antifoaming agents may be lower than or equal to the above-cited values.

When the total content of surfactants and antifoaming agents is higher than or equal to any of the above-cited values, it is beneficial in terms of ejection consistency and filter lifetime provided that the composition is not circulated. Surfactants and antifoaming agents in the composition are likely to form oil droplets during circulation, and such droplets may clog the filter or degrade the ejection consistency of the composition. Such problems can be prevented by omitting the circulation of the non-coloring composition.

Also, not only when the total content of surfactants and antifoaming agents is any of the above-cited values, but also when it is higher than the total content by mass of the surfactants and antifoaming agents in the coloring ink composition, the non-coloring composition can satisfactorily wet the printing medium and spread sufficiently and tends to exhibit high ejection consistency, compared to the coloring ink composition. If such a non-coloring composition is circulated, the non-coloring composition tends to exhibit unsatisfactory ejection consistency and reduce filter lifetime, compared to the coloring ink composition. Accordingly, it is not beneficial to circulate the non-coloring composition.

The surfactant content in the non-coloring composition may be 0.5% or more, for example, 1.0% or more or 1.5% or more, relative to the total mass of the non-coloring composition. In an embodiment, the surfactant content may be 2% by mass or more. Also, the upper limit of the surfactant content is not limited but may be, by mass, 5% or less, for example, 4% or less or 3% or less.

The antifoaming agent content in the non-coloring composition may be 0.1% or more or 0.5% or more, relative to the total mass of the non-coloring composition. Also, the upper limit of the antifoaming agent content is not limited but may be, by mass, 2% or less, for example, 1% or less or 0.5% or less.

The water content in the non-coloring composition may be 30% or more, for example, 45% or more or 55% or more, relative to the total mass of the non-coloring composition.

Clear Ink Composition

The non-coloring composition may be a clear ink composition. In this instance, the clear ink composition is not intended to color the printing medium and is used to enhance adhesion to the printing medium and improve the image quality, such as abrasion resistance and gloss, of the printed item. Accordingly, the coloring material content in the clear ink composition is as described above. The clear ink composition may be applied onto the printing medium simultaneously with, before, or after the application of the coloring ink composition. In some embodiments, the clear ink composition may be applied simultaneously with or after the application of the coloring ink composition. The clear ink composition is not the treatment liquid described later herein and contains no flocculant. The constituents, except the flocculant, of the clear ink composition and the contents thereof may be the same as those of the treatment liquid and may be selected independently of the treatment liquid.

Treatment Liquid

The non-coloring composition may be a treatment liquid. In this instance, the treatment liquid contains a flocculant capable of flocculating or thickening the coloring ink composition. The coloring ink composition described above can produce printed items having high image quality when used together with the treatment liquid in a printing method. The flocculant in the treatment liquid interacts with coloring ink composition to flocculate one or more components of the coloring ink composition, thus thickening or insolubilizing the coloring ink composition. Consequently, droplets of the coloring ink composition are prevented from interfering with each other when landed or from bleeding, and thus evenly forming high-definition images or the like. The treatment liquid may be applied onto the printing medium simultaneously with, before, or after the application of the coloring ink composition. In some embodiments, the treatment liquid may be applied onto the printing medium simultaneously with or before the application of the coloring ink composition.

The constituents of the treatment liquid and the contents thereof may be the same as those of the clear ink composition and may be selected independently of the clear ink composition, except that the treatment liquid contains a flocculant.

Flocculant

The flocculant that may be contained in the non-coloring composition may be, but is not limited to, a cationic resin, an organic acid, a multivalent metal salt. Such a flocculant is effective in reducing nonuniform slid areas and bleeding. Constituents in the coloring ink composition that can be flocculated by the flocculant include the pigment and the resin of resin particles.

The cationic resin may be, but is not limited to, a cationic polymer. Examples of the cationic polymer that may be used from the viewpoint of producing advantageous effects with reliability include polyethyleneimine, polyallylamine-based resins, such as polydiallylamine and polyallylamine, alkylamine polymers, polymers containing any of the primary to tertial amino groups and a quaternary ammonium group that are disclosed in JP-A-59-20696, JP-A-59-33176, JP-A-59-33177, JP-A-59-155088, JP-A-60-11389, JP-A-60-49990, JP-A-60-83882, JP-A-60-109894, JP-A-62-198493, JP-A-63-49478, JP-A-63-115780, JP-A-63-280681, JP-A-1-40371, JP-A-6-234268, JP-A-7-125411, or JP-A-10-193776. From the same viewpoint, the weight average molecular weight of the cationic polymer may be 5000 or more, for example, from 5000 to about 100,000. The weight average molecular weight of the cationic polymer can be determined by gel permeation chromatography using polystyrene as a reference material.

An amine-based resin may be selected from among cationic resins. The amine-based resin may be a cationic polyallylamine resin, polyamine resin, or polyamide resin. The polyallylamine, polyamine resin and polyamide resin have a polyallylamine structure, a polyamine structure, and a polyamide structure, respectively, in the main skeleton thereof. Cationic resin may be present in the form of resin particles or dissolved in the treatment liquid. The cationic resin that can be present in the form of resin particles can be the flocculant.

The organic acid may be, but is not limited to, a carboxylic acid, and such organic acids include maleic acid, acetic acid, oxalic acid, malonic acid, and citric acid. In some embodiments, a monovalent or a divalent carboxylic acid may be used. Such a carboxylic acid tends to be effective in flocculating resin particles and wax and to lead to satisfactory color development. Organic acids may be used individually or in combination.

The multivalent metal salt is not particularly limited and may be a metal salt of an inorganic acid or an organic acid from the viewpoint of producing advantageous effects with reliability. Examples of such a multivalent metal salt include, but are not limited to, salts of periodic table Group 2 metals or alkaline-earth metals, such as magnesium and calcium, salts of transition metals in periodic table Group 3, such as lanthanum, salts of earth metals in periodic table Group 13, such as aluminum, and salts of Lanthanides, such as neodymium. More specifically, salts of such multivalent metals include carboxylates, such as formates, acetates, and benzoates, sulfates, nitrates, chlorides, and thiocyanates. In some embodiments, the multivalent metal salt may be one or more compounds selected from the group consisting of calcium and magnesium carboxylates (formats, acetates, benzoates, etc.), calcium sulfate, magnesium sulfate, calcium nitrate, magnesium nitrate, calcium chloride, magnesium chloride, calcium thiocyanate, and magnesium thiocyanate. Such multivalent metal salts may be used individually or in combination.

The flocculant content, in terms of solids, may be 0.1% to 25%, for example, 1.0% to 20%, 2.0% to 10%, or 3.0% to 8%, relative to the total mass of the non-coloring composition. When the flocculant content is in such a range, the resulting printed item tends to have high image quality.

In some embodiments, the treatment liquid contains at least either resin particles or a wax, and a flocculant. The treatment liquid is useful in enhancing the adhesion of the coloring ink composition to the printing medium and the abrasion resistance of the printed item. When the treatment liquid is used, it is not beneficial to circulate the treatment liquid from the viewpoint of ensuring sufficient ejection consistency and filter lifetime. In some embodiments, the treatment liquid contains resin particles and a flocculant. In this instance, the resin particles facilitate uniform application of the flocculant onto the printing medium, thus helping to produce high image quality.

EXAMPLES

The subject matter of the present disclosure will be further described in detail with reference to Examples. However, the implementation of the concept of the present disclosure is not limited to the following Examples.

Constituents of Coloring Ink Composition, Clear Ink Composition, and Treatment Liquid The following substances were mainly used in the compositions for producing printed items.

Pigment:

C.I. Pigment Blue 15:3

Flocculant:

Catiomaster PD-7 (amine-epichlorohydrin condensation polymer (cationic polymer) produced by Yokkaichi Chemical)

Calcium nitrate

Resin Particles:

Polysol AT860 (acrylic resin emulsion, produced by Showa Denko) Wax:

AQUACER 507 (paraffin wax, produced by BYK)

Organic Solvent:

1,2-Hexanediol

2-Pyrrolidone

Propylene glycol

Surfactant:

BYK 348 (silicone surfactant, produced by BYK) Antifoaming Agent:

Surfynol DF110D (acetylene glycol-based surfactant, produced by Nissin Chemical Industry)

Water:

Pure water

Preparation of Coloring Ink Composition, Clear Ink Composition, and Treatment Liquid The pigment presented above and a styrene-acrylic dispersant resin for the pigment (not presented in the Tables) in a mass proportion of 2:1 (=pigment:dispersant resin) were mixed in water, and the mixture was agitated in a bead mill to yield a pigment dispersion liquid. A coloring ink composition, clear ink compositions, and treatment liquids were prepared as presented in Table 1 by mixing the pigment dispersion liquid and other constituents and thoroughly stirring the mixture. The values in Table 1 are represented by percent by mass on a solid basis except for those of organic solvents and water that are simply represented by percent by mass, and the total content of individual compositions is 100.0% by mass.

TABLE 1

| | | Coloring ink composition | Clear ink composition | | |
|---|---|---|---|---|---|
| | | Color A | Clear A | Clear B | Clear C |
| Pigment | Pigment Blue 15:3 | 7 | — | — | — |
| Flocculant | Catiomaster PD-7 | — | — | — | — |
| | Calcium nitrate | — | — | — | — |
| Resin particles | Polysol AT 860 | 5 | 5.5 | 7 | 7 |
| Wax | AQUACER507 | 1 | 1.5 | 2 | 2 |
| Organic solvent | 1,2-Hexanediol | 2 | 2 | 2 | 2 |
| | 2-Pyrrolidone | 15 | 15 | 15 | 15 |
| | Propylene glycol | 9 | 9 | 9 | 19 |
| Surfactant | BYK348 | 1 | 1 | 1 | 1 |
| Antifoaming agent | DF110D | 0.2 | 0.2 | 0.2 | 0.2 |
| Water | | Balance | Balance | Balance | Balance |
| Total | | 100 | 100 | 100 | 100 |
| Sum of the masses of resin particles and wax | | 6 | 7 | 9 | 9 |
| Sum of the masses of surfactant and antifoaming agent | | 1.2 | 1.2 | 1.2 | 1.2 |

| | | Treatment liquid | | | | |
|---|---|---|---|---|---|---|
| | | Treatment liquid A | Treatment liquid B | Treatment liquid C | Treatment liquid D | Treatment liquid E |
| Pigment | Pigment Blue 15:3 | — | — | — | — | — |
| Flocculant | Catiomaster PD-7 | 7 | — | 7 | 7 | 7 |
| | Calcium nitrate | — | 7 | — | — | — |
| Resin particles | Polysol AT 860 | — | 2 | 3 | | |

TABLE 1-continued

| | | | | | | |
|---|---|---|---|---|---|---|
| Wax | ACUACER507 | | | 1 | | |
| Organic solvent | 1,2-Hexanediol | 2 | 2 | 2 | 2 | 2 |
| | 2-Pyrrolidone | 15 | 15 | 15 | 15 | 15 |
| | Propylene glycol | 9 | 9 | 9 | 9 | 19 |
| Surfactant | BYK348 | 1.5 | 2 | 2 | 2 | 2 |
| Antifoaming agent | DF110D | 0.3 | 0.5 | 0.5 | 0.5 | 0.5 |
| Water | | Balance | Balance | Balance | Balance | Balance |
| Total | | 100 | 100 | 100 | 100 | 100 |
| Sum of the masses of resin particles and wax | | 0 | 2 | 4 | 0 | 0 |
| Sum of the masses of surfactant and antifoaming agent | | 1.8 | 2.5 | 2.5 | 2.5 | 2.5 |

| | | Treatment liquid | | | |
|---|---|---|---|---|---|
| | | Treatment liquid F | Treatment liquid G | Treatment liquid H | Treatment liquid I |
| Pigment | Pigment Blue 15:3 | — | — | — | — |
| Flocculant | Catiomaster PD-7 | 7 | 7 | 7 | 1 |
| | Calcium nitrate | — | — | — | — |
| Resin particles | Polysol AT 860 | | 2 | | 1 |
| Wax | ACUACER507 | | | | |
| Organic solvent | 1,2-Hexanediol | 2 | 2 | 2 | 2 |
| | 2-Pyrrolidone | 15 | 15 | 15 | 15 |
| | Propylene glycol | 9 | 9 | 9 | 9 |
| Surfactant | BYK348 | 2 | 2 | 1 | 2 |
| Antifoaming agent | DF110D | 0.3 | 0.5 | 0.2 | 0.5 |
| Water | | Balance | Balance | Balance | Balance |
| Total | | 100 | 100 | 100 | 100 |
| Sum of the masses of resin particles and wax | | 0 | 2 | 0 | 1 |
| Sum of the masses of surfactant and antifoaming agent | | 2.3 | 2.5 | 1.2 | 2.5 |

A Seiko Epson printer L-4533A was modified into a line printer for one-pass printing so that the printing medium could be continuously transported with ink jet heads fixed in position during printing. When a clear ink composition was used, a first composition ink jet head and a second composition ink jet head were arranged in this order in the medium transport direction. When a treatment liquid was used, the second composition ink jet head and the first composition ink jet head were arranged in this order in the medium transport direction.

For a serial printer, a Seiko Epson printer SC-S40650 was modified so that a first composition and a second composition individually filled either of the nozzle lines aligned in the main scanning direction.

In the description here, the first composition refers to the coloring ink composition, and the second composition refers to a clear ink composition or a treatment liquid. When the line printer and the serial printer need not be distinguished, they are hereinafter simply referred to as the printer.

The printers were adapted to control the platen heater to control the surface temperature of the printing medium during application of the compositions. The ink jet heads were provided with a composition heating mechanism capable of heating the composition. More specifically, the composition heating mechanism was a sheet heater that is a heating resistor sandwiched between resin sheets, and the sheet heater was provided in close contact with the surface of the ink jet head at which the ejection openings are arranged. For temperature control, the composition heating mechanism was actuated to heat the composition in the ink jet head to 35° C. When temperature was not controlled, the composition heating mechanism was not actuated.

The temperature (highest temperature during printing) at the printing surface of the printing medium was increased to 35° C. at a position opposing the ink jet head with the platen heater operating.

The printers were provided with a cap to cover the nozzles to prevent the nozzles from drying while not operating, a cloth wiper mechanism to wipe the nozzle face of the ink jet head, a flushing box to receive the composition that has flushed the nozzles, and a suction mechanism to suck the composition from the nozzles of the head for cleaning. Flushing is the operation of discharging a composition not for printing but for maintenance, and more specifically of discharging the composition that is being dried and thickened.

The ink jet heads of the printer have the circulation mechanism shown in FIGS. 2 and 3. A circulation path outside the ink jet head was provided with a heater. The ink jet heads individually have 600 nozzles at a density of 600 npi (nozzles per inch), and the length of individual ones of the nozzle lines was 1 inch. For the line printer, a plurality of ink jet heads were arranged in the width direction of the printing medium in a staggered manner. In the Examples in which circulation was omitted, one or more ink jet heads similar to the above-described ink jet head but not having the circulation mechanism were used.

The printing medium was heated to 80° C. (highest temperature) for secondary dry with a secondary heating mechanism provided downstream from the ink jet head(s).

In the ink jet head provided with a circulation mechanism, the amount of circulation, which is represented by a value per head, was set to be equal to the maximum amount of ejection for printing. The maximum amount of ejection for printing is represented by the amount of ejection when a maximum amount of droplets are ejected at a maximum ejection frequency through all the nozzles that can be used for printing. Hence, the same amount of a composition as the maximum amount of ejection was circulated.

In the Examples represented as "done" in the row of "onto Printing medium" for "Flushing" in Tables 2 to 6, the composition was discharged, during printing, for flushing onto an area of the printing medium where a test pattern was not printed.

In the Examples in which flushing was performed onto the cap or the cloth wiper or into the flushing box, the row of the corresponding member for "Flushing" was represented as "done" in the Tables. In the Examples using the serial printer, such flushing was performed every two passes (for one reciprocation of the carriage). In the Examples using the line printer, the line heads were moved in a lateral direction for flushing the corresponding member with printing paused, and after the flushing, printing operation was resumed. For a serial printer, flushing can be performed without pausing for a considerable time. However, while the composition is ejected through some of the nozzles for printing, the other nozzles were not used for ejection. Also, a member to receive the composition discharged for flushing such as a flushing box was needed. On the other hand, when a line printer was used, printing was paused for a considerable time for flushing onto or into a member. Flushing onto the printing medium can be performed without using a member to receive the composition discharged, or pausing printing, while the coloring ink composition, when used, is to be ejected onto an unprinted area of the printing medium.

The printing medium used was an oriented polypropylene (OPP) PYLEN P2102, manufactured by Toyobo. The printing width was 40 cm. For the line printer, the first composition and the second composition were applied in the order in which the ink jet heads were arranged in the medium transport direction. For the serial printer, the compositions were simultaneously applied. The first composition and the second composition were superimposed for printing a test pattern. The amount of the first composition applied to the test pattern was 7 mg/inch$^2$, and the amount of the second composition applied was 30% by mass of the amount of the first composition.

In Tables below, the ink jet head used for the first composition was represented as "1st", and the ink jet head used for the second composition was represented as "2nd". The first composition and the second composition may be referred to as the first ink and the second ink, respectively.

Mass of Apparatus

The ink jet head having circulation paths was provided with a composition heating mechanism (sheet heater) so as to control the temperature of the circulation paths including the portion outside the ink jet head. The total mass of the individual ink jet head and the circulation mechanism including the circulation mechanism outside the head and the heating mechanism was measured. The sum of such total masses for the first composition and the second composition was calculated. The mass of the printer in an Example in which the first composition ink jet head has a circulation mechanism, while the second ink jet head was not provided with a circulation mechanism was defined as 100%. The mass of the apparatuses was evaluated according to the criteria below. The ink jet heads provided with circulation paths became large due to the spaces for the circulation paths. For the ink jet heads provided with a circulation path outside, the weight of the head including the heating mechanism increased by the mass of the heating mechanism.

Criteria

A: 100% or less

B: More than 100% to 120%

C: More than 120%

Image Quality

Flushing visibility (FL visibility)

Flushing was performed during printing onto an area other than the region in which a test pattern was to be printed. It was checked whether or not the dots formed on the printing medium by the flushing were visible, and such visibility was evaluation according to the criteria below. The amount of a droplet for flushing was 7 ng.

Criteria

A: Flushing dots were not visible.

B: Flushing dots were slightly visible.

C: Flushing dots were considerably visible.

Streaks

A test pattern was printed 50 cm in the medium transport direction on the printing medium across the width of the printing medium capable of being printed. Then, the test pattern was visually checked for streaks (streaks resulting from inconsistencies in tone of the composition) extending in the medium transport direction for the line printer or streaks extending in the main scanning direction for the serial printer. The image quality in terms of streaks was evaluated according to the criteria below. The present inventors supposed that abnormal ejection (ejection failure, deviation or scattering, fluctuation of ejection amount) through a nozzle causes inconsistencies in tone only at the portion of the pattern printed with the composition ejected through the nozzle.

Criteria

A: No streaks were visible.

B: Streaks were slightly visible.

C: Streaks were conspicuous.

Ruled lines

Ruled lines of 0.3 mm in width were printed in the longitudinal and transvers directions of the printing medium. The ruled lines were checked by visual observation, and image quality in terms of ruled lines was evaluated according to the criteria below. The present inventors supposed that abnormal ejection (ejection failure, deviation or scattering, fluctuation of ejection amount) through a nozzle causes a defect only at the portion of the ruled lines printed with the composition ejected through the nozzle.

Criteria

A: There were no breaks, deviation, or inconstant width in the ruled lines.

B: There were small breaks, slight deviation, slightly inconstant width in the ruled lines.

C: There were conspicuous breaks or deviation or conspicuously inconstant width in the ruled lines.

Bleeding

Complex kanji characters meaning eagle were printed at 10 points and 5 points in an outlined typeface with the first composition. The second composition was applied onto the resulting pattern of the first composition to cover the pattern including the outlined characters. The conditions of the outlined characters were checked by visual observation over the front side of the printing medium. The image quality of the printed item was evaluated in bleeding according to the following criteria.

Criteria

A: There was no bleeding, and 5-point outlined characters were legible.

B: Five-point outlined characters were illegible, while 10 point-outlined characters were legible.

C: Even 10-point outline characters were illegible due to bleeding.

Ejection Consistency

After 180-minute continuous printing of the same pattern as the test pattern printed for checking for streaks, the ejection through the nozzles filled with the composition was checked, and ejection consistency was evaluated according to the criteria below. Ejection consistency of some of the nozzles was degraded, and foreign matter was found in some of such nozzles or the pressure chambers corresponding thereto. In this instance, the inventors supposed that the foreign matter caused degradation of ejection consistency.

Criteria

A: No nozzle failed in ejection.

B: No nozzle failed in ejection, but some of the nozzles caused droplets to deviate a half the distance between nozzles from the proper landing positions.

C: 2% or less of the nozzles failed in ejection.

D: More than 2% of the nozzles failed in ejection.

Filter Lifetime

The ink jet heads were provided with a 10 μm-mesh filter at the inlets through which the composition was fed. Printing was performed for 7 hours a day under the same conditions as the printing for evaluating ejection consistency. Such printing was performed every day for 3 months. After 3 months, the filter of the ink jet head was checked by visual observation or through a magnifier, and the filter lifetime was evaluated according to the following criteria.

Criteria

A: The composition was able to pass through the filter as before the test, and no foreign matter was found in the filter.

B: The composition was able to pass through the filter as before the test, but foreign matter was found to some extent in the filter.

C: Foreign matter was found in the filter, and the degree of composition passing was slightly reduced.

D: Foreign matter was found in the filter, and the degree of composition passing was obviously reduced.

Abrasion resistance

The test pattern printed for evaluation in terms of streaks was rubbed reciprocally 100 times at a speed of 30 reciprocations per minutes with a Gakushin-type rubbing tester AB-301 (manufactured by TESTER SANGYO) under the conditions where a load of 170 g was placed on a dry white cotton rubbing test cloth (in accordance with JIS L 0803). Then, the test pattern was checked by visual observation and evaluated in terms of abrasion resistance according to the following criadera.

Criteria

A: No scratches or flaws occurred in the test pattern.

B: Some scratches or flaws occurred in the test pattern.

C: Conspicuous scratches or flaws occurred in the test pattern.

Maintenance Reliability

Recovery by Cleaning

In a state where all the nozzles were normal, the nozzles were cleaned under the cleaning condition presented in Tables 2 to 6. In the case of "decompress", 1 cc of the composition per head was sucked from the nozzles with a suction mechanism. In the case of "compress", 1 cc of the composition per head was discharged by compressing the composition in the ink jet head from an upstream position from the head. After such cleaning, the nozzles were checked, and recovery by cleaning was evaluated according to the following criteria.

Criteria

A: No nozzle failed in ejection.

B: 2% or less of the nozzles failed in ejection.

C: More than 2% of the nozzles failed in ejection.

Capping

In a state where all the nozzles were normal, the nozzle face was covered with a cap, and the printer was allowed to stand in an environment of 30° C. for 24 hours. Then, the nozzles were checked, and the effect of capping was evaluated according to the following criteria.

Criteria

A: No nozzle failed in ejection.

B: 2% or less of the nozzles failed in ejection.

C: More than 2% of the nozzles failed in ejection.

Wiping

In a state where all the nozzles were normal, the nozzle face was wiped with a cloth wiper. Then, the nozzles were checked, and the effect of wiping was evaluated according to the following criteria.

Criteria

A: No nozzle failed in ejection.

B: 2% or less of the nozzles failed in ejection.

C: More than 2% of the nozzles failed in ejection.

The above-described capping and wiping tests were conducted under a condition where some members of the printer were dirty because it had been used for a while. When flushing dirtied an edge of the cap and resulted in reduced air-tight condition or dirtied the cloth wiper, nozzles were contaminated on the contrary in some cases.

TABLE 2

| Compositions | | Example 1 | | Example 2 | | Example 3 | | Example 4 | |
|---|---|---|---|---|---|---|---|---|---|
| | | 1st Color A | 2nd Clear B | 1st Color A | 2nd Clear B | 1st Color A | 2nd Clear B | 1st Color A | 2nd Clear B |
| Printing type | | Line | | Line | | Serial | | Serial | |
| Inkjet head | Circulation mechanism | Provided | — | Provided | — | Provided | — | Provided | — |
| | Temperature control | Provided | — | — | — | Provided | — | Provided | — |
| Flushing | onto Printing medium | — | Done | — | Done | — | — | — | — |
| | onto Cap | — | — | — | — | Done | Done | Done | Done |
| | onto Cloth wiper | — | — | — | — | — | — | — | — |

TABLE 2-continued

| | | | | | | | | | |
|---|---|---|---|---|---|---|---|---|---|
| | into Flushing box | — | — | — | — | — | — | — | — |
| Cleaning | | Compress | Compress | Compress | Compress | Compress | Compress | Decompress | Decompress |
| Mass of apparatus | | A | | A | | A | | A | |
| Image quality | FL visibility | A | | A | | A | | A | |
| | Streaks | A | | B | | A | | A | |
| | Ruled lines | A | | A | | A | | A | |
| | Bleeding | B | | B | | B | | B | |
| Ejection consistency | | A | A | B | A | A | A | A | A |
| Filter lifetime | | A | A | A | A | A | A | A | A |
| Rub fastness | | A | | A | | A | | A | |
| Maintenance reliability | Recovery by cleaning | A | A | A | A | A | A | B | B |
| | Capping | A | A | A | A | B | B | B | B |
| | Wiping | A | A | A | A | A | A | A | A |

| | | Example 5 | | Example 6 | | Example 7 | | Example 8 | |
|---|---|---|---|---|---|---|---|---|---|
| Compositions | | 1st Color A | 2nd Clear B | 1st Color A | 2nd Clear B | 1st Color A | 2nd Clear C | 1st Color A | 2nd Clear A |
| Printing type | | Serial | | Serial | | Serial | | Line | |
| Inkjet head | Circulation mechanism | Provided | — | Provided | — | Provided | — | Provided | — |
| | Temperature control | Provided | — | Provided | — | Provided | — | Provided | — |
| Flushing | onto Printing medium | Not done | — | — | — | — | Done | — | Done |
| | onto Cap | — | — | — | — | — | — | — | — |
| | onto Cloth wiper | Done | Done | — | — | — | — | — | — |
| | into Flushing box | — | — | Done | Done | — | — | — | — |
| Cleaning | | Compress | Compress | Compress | Compress | Compress | Compress | Compress | Compress |
| Mass of apparatus | | A | | A | | A | | A | |
| Image quality | FL visibility | A | | A | | A | | A | |
| | Streaks | A | | A | | A | | A | |
| | Ruled lines | A | | A | | A | | A | |
| | Bleeding | B | | B | | B | | B | |
| Ejection consistency | | A | A | A | A | A | B | A | A |
| Filter lifetime | | A | A | A | A | A | A | A | A |
| Rub fastness | | A | | A | | A | | B | |
| Maintenance reliability | Recovery by cleaning | A | A | A | A | A | A | A | A |
| | Capping | A | A | A | A | A | A | A | A |
| | Wiping | B | B | A | A | A | A | A | A |

TABLE 3

| | | Comparative Example 1 | | Comparative Example 2 | | Comparative Example 3 | | Comparative Example 4 | |
|---|---|---|---|---|---|---|---|---|---|
| Compositions | | 1st Color A | 2nd Clear B | 1st Color A | 2nd Clear B | 1st Color A | 2nd Clear B | 1st Color A | 2nd Clear B |
| Printing type | | Line | | Line | | Line | | Serial | |
| Inkjet head | Circulation mechanism | — | — | — | — | — | — | — | — |
| | Temperature control | — | — | Provided | — | Provided | — | Provided | — |
| Flushing | onto Printing medium | — | Done | Done | Done | — | Done | — | Done |
| | onto Cap | — | — | — | — | — | — | — | — |
| | onto Cloth wiper | — | — | — | — | — | — | — | — |
| | into Flushing box | — | — | — | — | Done | — | Done | — |
| Cleaning | | Compress | Compress | Compress | Compress | Compress | Compress | Compress | Compress |
| Mass of apparatus | | A | | A | | A | | A | |
| Image quality | FL visibility | A | | C | | A | | A | |
| | Streaks | C | | A | | C | | A | |
| | Ruled lines | C | | A | | C | | C | |
| | Bleeding | C | | B | | C | | C | |
| Ejection consistency | | C | A | A | A | B | A | B | A |
| Filter lifetime | | A | A | A | A | A | A | A | A |

TABLE 3-continued

| | | | | | | | | | |
|---|---|---|---|---|---|---|---|---|---|
| Rub fastness | | A | | A | | A | | A | |
| Maintenance reliability | Recovery by cleaning | A | A | A | A | A | A | A | A |
| | Capping | A | A | A | A | A | A | A | A |
| | Wiping | A | A | A | A | A | A | A | A |

| | | | Comparative Example 5 | | Comparative Example 6 | | Comparative Example 7 | |
|---|---|---|---|---|---|---|---|---|
| Compositions | | | 1st Color A | 2nd Clear B | 1st Color A | 2nd Clear B | 1st Color A | 2nd Clear A |
| Printing type | | | Line | | Line | | Line | |
| Inkjet head | Circulation mechanism | | Provided | Provided | Provided | Provided | Provided | Provided |
| | Temperature control | | Provided | Provided | Provided | — | Provided | Provided |
| Flushing | onto Printing medium | | — | Done | — | Done | — | Done |
| | onto Cap | | — | — | — | — | — | — |
| | onto Cloth wiper | | — | — | — | — | — | — |
| | into Flushing box | | — | — | — | — | — | — |
| Cleaning | | | Compress | Compress | Compress | Compress | Compress | Compress |
| Mass of apparatus | | | C | | C | | C | |
| Image quality | FL visibility | | A | | A | | A | |
| | Streaks | | A | | A | | A | |
| | Ruled lines | | A | | A | | A | |
| | Bleeding | | B | | B | | B | |
| Ejection consistency | | | A | C | A | B | A | B |
| Filter lifetime | | | A | C | A | C | A | C |
| Rub fastness | | | A | | A | | B | |
| Maintenance reliability | Recovery by cleaning | | A | A | A | A | A | A |
| | Capping | | A | A | A | A | A | A |
| | Wiping | | A | A | A | A | A | A |

TABLE 4

| | | Example 9 | | Example 10 | | Example 11 | | Example 12 | |
|---|---|---|---|---|---|---|---|---|---|
| Compositions | | 1st Color A | 2nd Treatment liquid D | 1st Color A | 2nd Treatment liquid D | 1st Color A | 2nd Treatment liquid D | 1st Color A | 2nd Treatment liquid D |
| Printing type | | Line | | Line | | Serial | | Serial | |
| Inkjet head | Circulation mechanism | Provided | — | Provided | — | Provided | — | Provided | — |
| | Temperature control | Provided | — | — | — | Provided | — | Provided | — |
| Flushing | onto Printing medium | — | Done | — | Done | — | — | — | — |
| | onto Cap | — | — | — | — | Done | Done | Done | Done |
| | onto Cloth wiper | — | — | — | — | — | — | — | — |
| | into Flushing box | — | — | — | — | — | — | — | — |
| Cleaning | | Compress | Compress | Compress | Compress | Compress | Compress | Decompress | Decompress |
| Mass of apparatus | | A | | A | | A | | A | |
| Image quality | FL visibility | A | | A | | A | | A | |
| | Streaks | A | | B | | A | | A | |
| | Ruled lines | A | | A | | A | | A | |
| | Bleeding | A | | A | | A | | A | |
| Ejection consistency | | A | A | B | A | A | A | A | A |
| Filter lifetime | | A | A | A | A | A | A | A | A |
| Rub fastness | | C | | C | | C | | C | |
| Maintenance reliability | Recovery by cleaning | A | A | A | A | A | A | B | B |
| | Capping | A | A | A | A | B | B | B | B |
| | Wiping | A | A | A | A | A | A | A | A |

TABLE 4-continued

| Compositions | | Example 13 | | Example 14 | | Example 15 | | Example 16 | |
|---|---|---|---|---|---|---|---|---|---|
| | | 1st Color A | 2nd Treatment liquid D | 1st Color A | 2nd Treatment liquid D | 1st Color A | 2nd Treatment liquid E | 1st Color A | 2nd Treatment liquid F |
| Printing type | | Serial | | Serial | | Serial | | Serial | |
| Inkjet head | Circulation mechanism | Provided | — | Provided | — | Provided | — | Provided | — |
| | Temperature control | Provided | — | Provided | — | Provided | — | Provided | — |
| Flushing | onto Printing medium | — | — | — | — | — | Done | — | Done |
| | onto Cap | — | — | — | — | — | — | — | — |
| | onto Cloth wiper | Done | Done | — | — | — | — | — | — |
| | into Flushing box | — | — | Done | Done | — | — | — | — |
| Cleaning | | Compress | Compress | Compress | Compress | Compress | Compress | Compress | Compress |
| Mass of apparatus | | A | | A | | A | | A | |
| Image quality | FL visibility | A | | A | | A | | A | |
| | Streaks | A | | A | | A | | A | |
| | Ruled lines | A | | A | | B | | A | |
| | Bleeding | A | | A | | A | | A | |
| Ejection consistency | | B | B | A | A | A | B | A | B |
| Filter lifetime | | A | A | A | A | A | A | A | A |
| Rub fastness | | C | | C | | C | | C | |
| Maintenance reliability | Recovery by cleaning | A | A | A | A | A | A | A | A |
| | Capping | A | A | A | A | A | A | A | A |
| | Wiping | B | B | A | A | A | A | A | A |

TABLE 5

| Compositions | | Example 17 | | Example 18 | | Example 19 | | Example 20 | |
|---|---|---|---|---|---|---|---|---|---|
| | | 1st Color A | 2nd Treatment liquid G | 1st Color A | 2nd Treatment liquid A | 1st Color A | 2nd Treatment liquid B | 1st Color A | 2nd Treatment liquid C |
| Printing type | | Serial | | Line | | Line | | Line | |
| Inkjet head | Circulation mechanism | Provided | — | Provided | — | Provided | — | Provided | — |
| | Temperature control | Provided | — | Provided | — | Provided | — | Provided | — |
| Flushing | onto Printing medium | — | Done | — | Done | — | Done | — | Done |
| | onto Cap | — | — | — | — | — | — | — | — |
| | onto Cloth wiper | — | — | — | — | — | — | — | — |
| | into Flushing box | — | — | — | — | — | — | — | — |
| Cleaning | | Compress | Compress | Compress | Compress | Compress | Compress | Compress | Compress |
| Mass of apparatus | | A | | A | | A | | A | |
| Image quality | FL visibility | A | | A | | A | | A | |
| | Streaks | A | | A | | A | | A | |
| | Ruled lines | A | | A | | A | | A | |
| | Bleeding | A | | B | | A | | A | |
| Ejection consistency | | A | B | A | B | A | B | A | B |
| Filter lifetime | | A | A | A | A | A | A | A | B |
| Rub fastness | | A | | C | | B | | A | |
| Maintenance reliability | Recovery by cleaning | A | A | A | A | A | A | A | A |
| | Capping | A | A | A | A | A | A | A | A |
| | Wiping | A | A | A | A | A | A | A | A |

TABLE 5-continued

| Compositions | | Example 21 | | Example 22 | | Example 23 | | Comparative Example 8 | |
|---|---|---|---|---|---|---|---|---|---|
| | | 1st Color A | 2nd Treatment liquid H | 1st Color A | 2nd Treatment liquid I | 1st Color A | 2nd Treatment liquid D | 1st Color A | 2nd Treatment liquid D |
| Printing type | | Line | | Line | | Line | | Line | |
| Inkjet head | Circulation mechanism | Provided | — | Provided | — | Provided | — | — | — |
| | Temperature control | Provided | — | Provided | — | Provided | Provided | — | — |
| Flushing | onto Printing medium | — | Done | — | Done | — | Done | — | Done |
| | onto Cap | — | — | — | — | — | — | — | — |
| | onto Cloth wiper | — | — | — | — | — | — | — | — |
| | into Flushing box | — | — | — | — | — | — | — | — |
| Cleaning | | Compress | Compress | Compress | Compress | Compress | Compress | Compress | Compress |
| Mass of apparatus | | A | | A | | A | | A | |
| Image quality | FL visibility | A | | A | | A | | A | |
| | Streaks | A | | A | | A | | C | |
| | Ruled lines | B | | A | | A | | C | |
| | Bleeding | B | | B | | A | | B | |
| Ejection consistency | | A | B | A | B | A | B | C | A |
| Filter lifetime | | A | A | A | A | A | B | A | A |
| Rub fastness | | C | | B | | C | | C | |
| Maintenance reliability | Recovery by cleaning | A | A | A | A | A | A | A | A |
| | Capping | A | A | A | A | A | A | A | A |
| | Wiping | A | A | A | A | A | A | A | A |

| Compositions | | Comparative Example 9 | | Comparative Example 10 | | Comparative Example 11 | |
|---|---|---|---|---|---|---|---|
| | | 1st Color A | 2nd Treatment liquid D | 1st Color A | 2nd Treatment liquid D | 1st Color A | 2nd Treatment liquid D |
| Printing type | | Line | | Line | | Serial | |
| Inkjet head | Circulation mechanism | — | — | — | — | — | — |
| | Temperature control | Provided | — | Provided | — | Provided | — |
| Flushing | onto Printing medium | Done | Done | — | Done | — | — |
| | onto Cap | — | — | — | — | — | — |
| | onto Cloth wiper | — | — | — | — | — | — |
| | into Flushing box | — | — | Done | — | Done | Done |
| Cleaning | | Compress | Compress | Compress | Compress | Compress | Compress |
| Mass of apparatus | | A | | A | | A | |
| Image quality | FL visibility | C | | A | | A | |
| | Streaks | A | | C | | A | |
| | Ruled lines | A | | C | | C | |
| | Bleeding | A | | B | | B | |
| Ejection consistency | | A | A | B | A | B | A |
| Filter lifetime | | A | A | A | A | A | A |
| Rub fastness | | C | | C | | C | |
| Maintenance reliability | Recovery by cleaning | A | A | A | A | A | A |
| | Capping | A | A | A | A | A | A |
| | Wiping | A | A | A | A | A | A |

TABLE 6

| Compositions | | Comparative Example 12 | | Comparative Example 13 | | Comparative Example 14 | | Comparative Example 15 | |
|---|---|---|---|---|---|---|---|---|---|
| | | 1st Color A | 2nd Treatment liquid D | 1st Color A | 2nd Treatment liquid G | 1st Color A | 2nd Treatment liquid G | 1st Color A | 2nd Treatment liquid A |
| Printing type | | Line | | Line | | Line | | Line | |
| Inkjet head | Circulation mechanism | Provided | Provided | Provided | Provided | Provided | Provided | Provided | Provided |
| | Temperature control | Provided | Provided | Provided | Provided | Provided | — | Provided | Provided |
| Flushing | onto Printing medium | — | Done | — | Done | — | Done | — | Done |
| | onto Cap | — | — | — | — | — | — | — | — |
| | onto Cloth wiper | — | — | — | — | — | — | — | — |
| | into Flushing box | — | — | — | — | — | — | — | — |
| Cleaning | | Compress | Compress | Compress | Compress | Compress | Compress | Compress | Compress |
| Mass of apparatus | | C | | C | | C | | C | |
| Image quality | FL visibility | A | | A | | A | | A | |
| | Streaks | A | | A | | A | | A | |
| | Ruled lines | A | | A | | A | | A | |
| | Bleeding | A | | A | | A | | B | |
| Ejection consistency | | A | C | A | D | A | C | A | C |
| Filter lifetime | | A | A | A | C | A | C | A | C |
| Rub fastness | | C | | A | | A | | B | |
| Maintenance reliability | Recovery by cleaning | A | A | A | A | A | A | A | A |
| | Capping | A | A | A | A | A | A | A | A |
| | Wiping | A | A | A | A | A | A | A | A |

| Compositions | | Comparative Example 16 | | Comparative Example 17 | | Comparative Example 18 | | Comparative Example 19 | |
|---|---|---|---|---|---|---|---|---|---|
| | | 1st Color A | 2nd Treatment liquid B | 1st Color A | 2nd Treatment liquid C | 1st Color A | 2nd Treatment liquid H | 1st Color A | 2nd Treatment liquid I |
| Printing type | | Line | | Line | | Line | | Line | |
| Inkjet head | Circulation mechanism | Provided | Provided | Provided | Provided | Provided | Provided | Provided | Provided |
| | Temperature control | Provided | Provided | Provided | Provided | Provided | Provided | Provided | Provided |
| Flushing | onto Printing medium | — | Done | — | Done | — | Done | — | Done |
| | onto Cap | — | — | — | — | — | — | — | — |
| | onto Cloth wiper | — | — | — | — | — | — | — | — |
| | into Flushing box | — | — | — | — | — | — | — | — |
| Cleaning | | Compress | Compress | Compress | Compress | Compress | Compress | Compress | Compress |
| Mass of apparatus | | C | | C | | C | | C | |
| Image quality | FL visibility | A | | A | | A | | A | |
| | Streaks | A | | A | | B | | A | |
| | Ruled lines | A | | A | | A | | A | |
| | Bleeding | A | | A | | B | | B | |
| Ejection consistency | | A | C | A | D | A | A | A | C |
| Filter lifetime | | A | C | A | D | A | A | A | C |
| Rub fastness | | B | | A | | C | | B | |
| Maintenance reliability | Recovery by cleaning | A | A | A | A | A | A | A | A |
| | Capping | A | A | A | A | A | A | A | A |
| | Wiping | A | A | A | A | A | A | A | A |

The results of the above tests or evaluations suggest the following.

Examples in which the first composition was ejected from the ink jet head having circulation paths, while the second composition was ejected from the ink jet head having no circulation paths resulted in high image quality and a reduced mass of the apparatus. In contrast, the Comparative Examples resulted in poor image quality or did not reduce the mass of the apparatus. The results will be described in detail below.

The comparison between Examples 1 and 2 suggests that the temperature control of the first composition ink jet head ink can increase image quality and ejection consistency.

The comparison, for example, between Examples 1 and suggests that flushing onto the cap slightly degrades maintenance reliability.

The comparison, for example, between Examples 1 and suggests that compression cleaning results in high evaluation in recovery by cleaning and effect of capping.

The comparison, for example, between Examples 1 and suggests that flushing onto the cloth wiper degrades maintenance reliability.

The comparison, for example, between Examples 1 and 6 suggests that flushing into the flushing box is effective in maintenance reliability but requires an additional member to receive the composition discharged for flushing.

The comparison, for example, between Examples 1 and shows that use of the non-coloring composition having a higher water content resulted in higher ejection consistency than the other.

The comparison, for example, among Examples 9, 17, and 20 shows that use of the non-coloring composition containing resin particles or wax in a higher proportion resulted in higher abrasion resistance but reduced ejection consistency and filter lifetime.

The comparison among Examples 9, 18, and 21 shows that use of the second composition containing the surfactant or the antifoaming agent in a lower proportion resulted in slightly degraded image quality and ejection consistency. This is probably because the compositions not containing a sufficient amount of sufficient surfactant or antifoaming agent did not allow the flocculant to wet the printing medium and spread sufficiently, and also because the coloring ink composition was not able to react with the flocculant due to deviation of landing droplets.

The comparison between Examples 9 and 19 shows that use of the treatment liquid using a cationic resin as the flocculant resulted in higher abrasion resistance but poorer ejection consistency than use of the other treatment liquid.

The comparison between Examples 9 and 22 shows that use of the treatment liquid having the higher flocculant content resulted in higher abrasion resistance but poorer image quality than the other treatment liquid.

The comparison between Examples 9 and 23 suggests that heating the non-coloring composition with the composition heating mechanism reduces the ejection consistency of the composition and the lifetime of the filter.

Comparative Examples 1 to 4, in which the coloring ink composition was not circulated, resulted in poor image quality.

Comparative Examples 5 to 7, in which the non-coloring composition was circulated, was not beneficial in terms of the mass of the apparatus and, in addition, resulted in poor ejection consistency and reduced lifetime of the filter.

Comparative Example 18, in which the non-coloring composition was circulated, resulted in satisfactory ejection consistency and lifetime of the filter. In treatment liquid H used in Comparative Example 18, the total content of resin particles and waxes was not 6.5% by mass or more, and the total content of surfactants and antifoaming agents was not 1.5% by mass or more. Also, the treatment liquid did not contain resin particles, a wax, or a flocculant. Furthermore, the total content of resin particles and waxes was not higher than that in the coloring ink composition, and the total content of surfactants and antifoaming agents was not higher than that in the coloring ink composition. Color ink A, in which the total content of resin particles and waxes was less than 6.5% by mass, exhibited satisfactory ejection consistency and filter lifetime even though the composition was circulated.

What is claimed is:

1. An ink jet printing method comprising:

a first application step of ejecting a coloring ink composition through an ejection opening of a first ink jet head to apply the coloring ink composition onto a printing medium, the coloring ink composition being circulated through a circulation path after being fed into the first ink jet head and before being elected through the ejection opening; and a second application step of ejecting a non-coloring composition through an ejection opening of a second ink jet head to apply the non-coloring composition onto the printing medium, the non-coloring composition being not circulated through a circulation path after being fed into the second ink jet head and before being ejected through the ejection opening, wherein the coloring ink composition contains a coloring material, and the non-coloring composition is a clear ink composition containing one material of resin particles and a wax or a treatment liquid containing a flocculant functioning to flocculate one or more components of the coloring ink composition.

2. The ink jet printing method according to claim 1, further comprising:

a flushing step of discharging the non-coloring composition for maintenance through the ejection opening of the second ink jet head.

3. The ink jet printing method according to claim 1, further comprising:

a composition heating step of heating the coloring ink composition with a composition heating mechanism before ejecting the coloring ink composition through the ejection opening of the first ink jet head, wherein the non-coloring ink is not heated before being ejected through the ejection opening of the second ink jet head.

4. The ink jet printing method according to claim 1, wherein the first ink jet head has a length larger than or equal to the width of the printing medium, and the first application step is performed by line printing that enables printing across the width of the printing medium with one scanning operation.

5. An ink jet printing method comprising:

a first application step of ejecting a coloring ink composition through an ejection opening of a first ink jet head to apply the coloring ink composition onto a printing medium, the coloring ink composition being circulated through a circulation path after being fed into the first ink jet head and before being ejected through the ejection opening; and a second application step of ejecting a non-coloring composition through an ejection opening of a second ink jet head to apply the non-coloring composition onto the printing medium, the non-coloring composition being not circulated through a circulation path after being fed into the second ink jet head and before being ejected through the ejection opening, wherein the non-coloring composition is any one of (1) to (3):

(1) a non-coloring composition containing one material of resin particles and a wax, in which the total content by mass of resin particles and waxes is higher than the total content by mass of resin particles and waxes in the coloring ink composition;

(2) a non-coloring composition containing one of a surfactant and an antifoaming agent, in which the total content by mass of surfactants and antifoaming agents is higher than the total content by mass of surfactants and antifoaming agents in the coloring ink composition; and (3) a non-coloring composition being a treatment liquid and containing a flocculant functioning to flocculate one or more components of the coloring ink composition, and resin particles or a wax.

6. The ink jet printing method according to claim 5, further comprising:

a flushing step of discharging the non-coloring composition for maintenance through the ejection opening of the second ink jet head.

7. The ink jet printing method according to claim 5, further comprising:

a composition heating step of heating the coloring ink composition with a composition heating mechanism before ejecting the coloring ink composition through the ejection opening of the first ink jet head, wherein the non-coloring ink is not heated before being ejected through the ejection opening of the second ink jet head.

8. The ink jet printing method according to claim 5, wherein the first ink jet head has a length larger than or equal to the width of the printing medium, and the first application step is performed by line printing that enables printing across the width of the printing medium with one scanning operation.

9. An ink jet printing method comprising:

a first application step of ejecting a coloring ink composition through an ejection opening of a first ink jet head to apply the coloring ink composition onto a printing medium, the coloring ink composition being circulated through a circulation path after being fed into the first ink jet head and before being ejected through the ejection opening; and a second application step of ejecting a non-coloring composition through an ejection opening of a second ink jet head to apply the non-coloring composition onto the printing medium, the non-coloring composition being not circulated through a circulation path after being fed into the second ink jet head and before being ejected through the ejection opening, wherein the non-coloring composition contains water in a proportion of 55% or more relative to the total mass of the non-coloring composition.

10. The ink jet printing method according to claim 9, further comprising:

a flushing step of discharging the non-coloring composition for maintenance through the ejection opening of the second ink jet head.

11. The ink jet printing method according to claim 9, further comprising:

a composition heating step of heating the coloring ink composition with a composition heating mechanism before ejecting the coloring ink composition through the ejection opening of the first ink jet head, wherein the non-coloring ink is not heated before being ejected through the ejection opening of the second ink jet head.

12. The ink jet printing method according to claim 9, wherein the first ink jet head has a length larger than or equal to the width of the printing medium, and the first application step is performed by line printing that enables printing across the width of the printing medium with one scanning operation.

13. An ink jet printing method comprising:

a first application step of electing a coloring ink composition through an ejection opening of a first ink jet head to apply the coloring ink composition onto a printing medium, the coloring ink composition being circulated through a circulation path after being fed into the first ink jet head and before being ejected through the ejection opening; and a second application step of ejecting a non-coloring composition through an ejection opening of a second ink jet head to apply the non-coloring composition onto the printing medium, the non-coloring composition being not circulated through a circulation path after being fed into the second ink jet head and before being ejected through the ejection opening, wherein the non-coloring composition contains one material of resin particles and a wax, and the total content of resin particles and waxes in the non-coloring composition is 6.5% or more relative to the total mass of the non-coloring composition.

14. The ink jet printing method according to claim 13, further comprising:

a flushing step of discharging the non-coloring composition for maintenance through the ejection opening of the second ink jet head.

15. The ink jet printing method according to claim 13, further comprising:

a composition heating step of heating the coloring ink composition with a composition heating mechanism before ejecting the coloring ink composition through the ejection opening of the first ink jet head, wherein the non-coloring ink is not heated before being ejected through the ejection opening of the second ink jet head.

16. The ink jet printing method according to claim 13, wherein the first ink jet head has a length larger than or equal to the width of the printing medium, and the first application step is performed by line printing that enables printing across the width of the printing medium with one scanning operation.

17. An ink jet printing method comprising:

a first application step of ejecting a coloring ink composition through an ejection opening of a first ink jet head to apply the coloring ink composition onto a printing medium, the coloring ink composition being circulated through a circulation path after being fed into the first ink jet head and before being ejected through the ejection opening; and a second application step of ejecting a non-coloring composition through an ejection opening of a second ink jet head to apply the non-coloring composition onto the printing medium, the non-coloring composition being not circulated through a circulation path after being fed into the second ink jet head and before being ejected through the ejection opening, wherein the non-coloring composition contains one of a surfactant and an antifoaming agent, and the total content of surfactants and antifoaming agents in the non-coloring composition is 1.5% or more relative to the total mass of the non-coloring composition.

18. The ink jet printing method according to claim 17, further comprising:

a flushing step of discharging the non-coloring composition for maintenance through the ejection opening of the second ink jet head.

19. The ink jet printing method according to claim 17, further comprising:

a composition heating step of heating the coloring ink composition with a composition heating mechanism before ejecting the coloring ink composition through the ejection opening of the first ink jet head, wherein the non-coloring ink is not heated before being ejected through the ejection opening of the second ink jet head.

20. The ink jet printing method according to claim 17, wherein the first ink jet head has a length larger than or equal to the width of the printing medium, and the first application step is performed by line printing that enables printing across the width of the printing medium with one scanning operation.

21. An ink jet printing method comprising:

a first application step of ejecting a coloring ink composition through an ejection opening of a first ink jet head to apply the coloring ink composition onto a printing medium, the coloring ink composition being circulated through a circulation path after being fed into the first ink jet head and before being ejected through the ejection opening; and a second application step of ejecting a non-coloring composition through an ejection opening of a second ink jet head to apply the non-coloring composition onto the printing medium, the non-coloring composition being not circulated through a circulation path after being fed into the second ink jet head and before being ejected through the ejection opening, wherein the non-coloring composition is a treatment liquid containing a flocculant functioning to flocculate one or more components of the coloring ink composition, and resin particles or a wax.

22. The ink jet printing method according to claim 21, further comprising:

a flushing step of discharging the non-coloring composition for maintenance through the ejection opening of the second ink jet head.

23. The ink jet printing method according to claim 21, further comprising:

a composition heating step of heating the coloring ink composition with a composition heating mechanism before ejecting the coloring ink composition through the ejection opening of the first ink jet head, wherein the non-coloring ink is not heated before being ejected through the ejection opening of the second ink jet head.

24. The ink jet printing method according to claim 21, wherein the first ink jet head has a length larger than or equal to the width of the printing medium, and the first application step is performed by line printing that enables printing across the width of the printing medium with one scanning operation.

25. An ink jet printing apparatus comprising:

a first ink jet head to which a coloring ink composition is fed, the first ink jet head having a circulation path through which the coloring ink composition circulates; and a second ink jet head to which a non-coloring composition is fed, the second ink jet head having no circulation path through which the non-coloring composition circulates, wherein the coloring ink composition contains a coloring material, and the non-coloring composition is a clear ink composition containing one material of resin particles and a wax or a treatment liquid containing a flocculant functioning to flocculate one or more components of the coloring ink composition.

* * * * *